US011848497B2

(12) United States Patent
Pance et al.

(10) Patent No.: US 11,848,497 B2
(45) Date of Patent: Dec. 19, 2023

(54) COUPLED DIELECTRIC RESONATOR AND DIELECTRIC WAVEGUIDE

(71) Applicant: Rogers Corporation, Chandler, AZ (US)

(72) Inventors: Kristi Pance, Auburndale, MA (US); Gianni Taraschi, Arlington, MA (US); Koen Hollevoet, Merelbeke (BE)

(73) Assignee: ROGERS CORPORATION, Chandler, AZ (US)

( * ) Notice: Subject to any disclaimer, the term of this patent is extended or adjusted under 35 U.S.C. 154(b) by 356 days.

(21) Appl. No.: 17/297,622

(22) PCT Filed: Nov. 13, 2019

(86) PCT No.: PCT/US2019/061068
§ 371 (c)(1),
(2) Date: May 27, 2021

(87) PCT Pub. No.: WO2020/112351
PCT Pub. Date: Jun. 4, 2020

(65) Prior Publication Data

US 2022/0045437 A1 Feb. 10, 2022

Related U.S. Application Data

(60) Provisional application No. 62/771,750, filed on Nov. 27, 2018.

(51) Int. Cl.
*H01Q 21/00* (2006.01)
*H01P 3/16* (2006.01)
(Continued)

(52) U.S. Cl.
CPC ..... *H01Q 21/0006* (2013.01); *H01P 3/16* (2013.01); *H01Q 9/0485* (2013.01); *H01Q 21/061* (2013.01)

(58) Field of Classification Search
CPC .. H01Q 21/006; H01Q 9/0485; H01Q 21/061; H01P 3/16
(Continued)

(56) References Cited

U.S. PATENT DOCUMENTS 6,198,450 B1 3/2001 Adachi et al.
9,401,537 B2 * 7/2016 Hendry ..... H01P 1/2086
2020/0133398 A1 * 4/2020 Williams ..... G06F 3/017

FOREIGN PATENT DOCUMENTS

JP 2003238242 * 8/2003 ..... C04B 35/46

OTHER PUBLICATIONS

Birand M. T. et al; "Experimental Millimetric Array Using Dielectric Radiators Fed by Means of Dielectric Waveguide", Electronics Letters, IEE Stevenage, GB, vol. 17, No. 18, Sep. 3, 1981; p. 633.
(Continued)

*Primary Examiner* — Peguy Jean Pierre
(74) *Attorney, Agent, or Firm* — CANTOR COLBURN LLP

(57) ABSTRACT

An electromagnetic device includes at least one dielectric resonator antenna, DRA, and at least one dielectric waveguide, DWG, configured so that during operation of the electromagnetic device, the at least one DRA provides an electromagnetic signal to the at least one DWG, or the at least one DWG provides an electromagnetic signal to the at least one DRA. The at least one DWG has a three-dimensional, 3D, shape that is different from a 3D shape of the at least one DRA.

20 Claims, 15 Drawing Sheets

(51) Int. Cl.
*H01Q 9/04* (2006.01)
*H01Q 21/06* (2006.01)

(58) Field of Classification Search
USPC ..... 343/843
See application file for complete search history.

(56) References Cited

OTHER PUBLICATIONS

Notification of Transmittal of the International Search Report of the International Application No. PCT/US2019/061068; dated Mar. 12, 2020; Report Received: Jul. 1, 2020; 8 pages.
Written Opinion of the International Searching Authority of the International Application No. PCT/US2019/061068; dated: Mar. 12, 2020; Report Received: Jul. 1, 2020; 13 pages.

* cited by examiner

COUPLED DIELECTRIC RESONATOR AND DIELECTRIC WAVEGUIDE

CROSS REFERENCE TO RELATED APPLICATIONS

This application claims the benefit of U.S. Provisional Application Ser. No. 62/771,750, filed 27 Nov. 2018, which is incorporated herein by reference in its entirety.

BACKGROUND OF THE INVENTION

The present disclosure relates generally to dielectric resonators and dielectric waveguides, and more particularly to a dielectric resonator antenna electromagnetically coupled to a dielectric waveguide.

An example dielectric resonator antenna is disclosed in US20170125908A1 assigned to Rogers Corp. An example dielectric waveguide is disclosed in WO2015157548A1 assigned to Texas Instruments Incorp.

While existing dielectric resonator antennas and dielectric waveguides may be suitable for their intended purpose, the art of coupled dielectric resonator antennas and dielectric waveguides would be advanced with a coupling structure that enhances the overall effectiveness, efficiency, and/or bandwidth of the coupled system.

BRIEF DESCRIPTION OF THE INVENTION

An embodiment includes an electromagnetic device, having: at least one dielectric resonator antenna, DRA; and at least one dielectric waveguide, DWG, configured so that during operation of the electromagnetic device, the at least one DRA provides an electromagnetic signal to the at least one DWG, or the at least one DWG provides an electromagnetic signal to the at least one DRA. The at least one DWG has a three-dimensional, 3D, shape that is different from a 3D shape of the at least one DRA.

Another embodiment includes an electromagnetic device, having: at least one first dielectric portion, 1DP, having a proximal end and a distal end, each of the at least one 1DP having a dielectric material other than air; at least one second dielectric portion, 2DP, having a proximal end and a distal end, the proximal end of a given 2DP being disposed proximate the distal end of a corresponding 1DP, the at least one 2DP having a dielectric material other than air; and at least a portion of the at least one 2DP forming a dielectric waveguide, DWG, adapted for internal transmission of an electromagnetic, EM, radiation field originating from the at least one 1DP when the at least one 1DP is electromagnetically excited.

Another embodiment includes an electromagnetic device, having: at least one first dielectric portion, 1DP, having a proximal end and a distal end, the 1DP having a dielectric material other than air; at least one second dielectric portion, 2DP, having a proximal end and a distal end, the proximal end of a given 2DP being disposed proximate the distal end of a corresponding 1DP, the at least one 2DP having a dielectric material other than air; at least one third dielectric portion, 3DP, having a proximal end and a distal end, the proximal end of a given 3DP being disposed proximate the distal end of a corresponding 2DP, the at least one 3DP having a dielectric material other than air; and the at least one 3DP forming a dielectric waveguide, DWG, adapted for internal transmission of an electromagnetic, EM, radiation field originating from the at least one 1DP when the at least one 1DP is electromagnetically excited.

Another embodiment includes an electromagnetic device, having: a substrate; at least one first dielectric portion, 1DP, having a proximal end and a distal end, each of the at least one 1DP having a dielectric material other than air, the proximal end of the at least one 1DP disposed on the substrate, the at least one 1DP extending substantially perpendicular to the substrate; at least one second dielectric portion, 2DP, having a proximal end and a distal end, the proximal end of a given 2DP being disposed proximate the distal end of a corresponding 1DP, the at least one 2DP having a dielectric material other than air, the at least one 2DP disposed on the substrate and extending substantially perpendicular to the substrate; the at least one 2DP forming a dielectric waveguide, DWG, adapted for internal transmission of an electromagnetic, EM, radiation field originating from the at least one 1DP when the at least one 1DP is electromagnetically excited.

Another embodiment includes an electromagnetic device, having: a substrate; at least one first dielectric portion, 1DP, having a proximal end and a distal end, each of the at least one 1DP having a dielectric material other than air, the proximal end of the at least one 1DP disposed on the substrate and extending substantially perpendicular to the substrate; at least one second dielectric portion, 2DP, having a proximal end and a distal end, the proximal end of a given 2DP being disposed proximate the distal end of a corresponding 1DP, the at least one 2DP having a dielectric material other than air, the at least one 2DP disposed at a defined distance from the substrate and extending substantially parallel to the substrate; a third dielectric portion, 3DP, disposed sideways adjacent to and on a first side of the at least one 2DP, the 3DP having a dielectric material other than air, the 3DP disposed on the substrate and extending substantially parallel to the substrate, a thickness of the 3DP defining the defined distance of the at least one 2DP from the substrate; and the at least one 2DP forming a dielectric waveguide, DWG, adapted for internal transmission of an electromagnetic, EM, radiation field originating from the at least one 1DP when the at least one 1DP is electromagnetically excited.

Another embodiment includes electromagnetic device, having: at least one first dielectric portion, 1DP, having a proximal end and a distal end, each of the at least one 1DP having a dielectric material other than air, the distal and proximal ends of the at least one 1DP configured and adapted to emit an electromagnetic, EM, radiation field that propagates in a first direction from the proximal end toward the distal end of the at least one 1DP when the at least one 1DP is electromagnetically excited; at least one second dielectric portion, 2DP, having a proximal end and a distal end, the proximal end of the at least one 2DP being disposed proximate the at least one 1DP, the at least one 2DP having a dielectric material other than air, the at least one 2DP disposed at a defined distance from the at least one 1DP; and the at least one 2DP forming a dielectric waveguide, DWG, adapted for internal transmission in a second direction of the EM radiation field, the second direction not parallel with the first direction, the at least one 2DP extending lengthwise from the corresponding proximal end to the corresponding distal end in the second direction.

Another embodiment includes an electromagnetic, EM, device, having: a connected array of dielectric resonator antennas, DRAs, having at least one non-gaseous dielectric material; and an adhesive layer disposed under the connected array of DRAs, wherein the adhesive layer includes a material different from the at least one non-gaseous dielectric material.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the appended claims. Accordingly, the following example embodiments are set forth without any loss of generality to, and without imposing limitations upon, the claimed invention disclosed herein.

An embodiment, as shown and described by the various figures and accompanying text, provides an electromagnetic, EM, device having a first dielectric portion, 1DP, such as for example a dielectric resonator antenna, DRA, and a second dielectric portion, 2DP, such as for example a dielectric waveguide, DWG, that are electromagnetically coupled to each other in such a manner (described in more detail below) that the 2DP is configured, adapted, and disposed, for internal transmission of an EM radiation near-field originating from the 1DP when electromagnetically excited. In an embodiment, the dielectric materials of the DWG are selected to result in total internal reflection of the EM signal that propagates within the DWG. Multiple DRAs may be electromagnetically coupled to a single DWG, or individual DRAs may be electromagnetically coupled to corresponding ones of individual DWGs.

Figure 1:
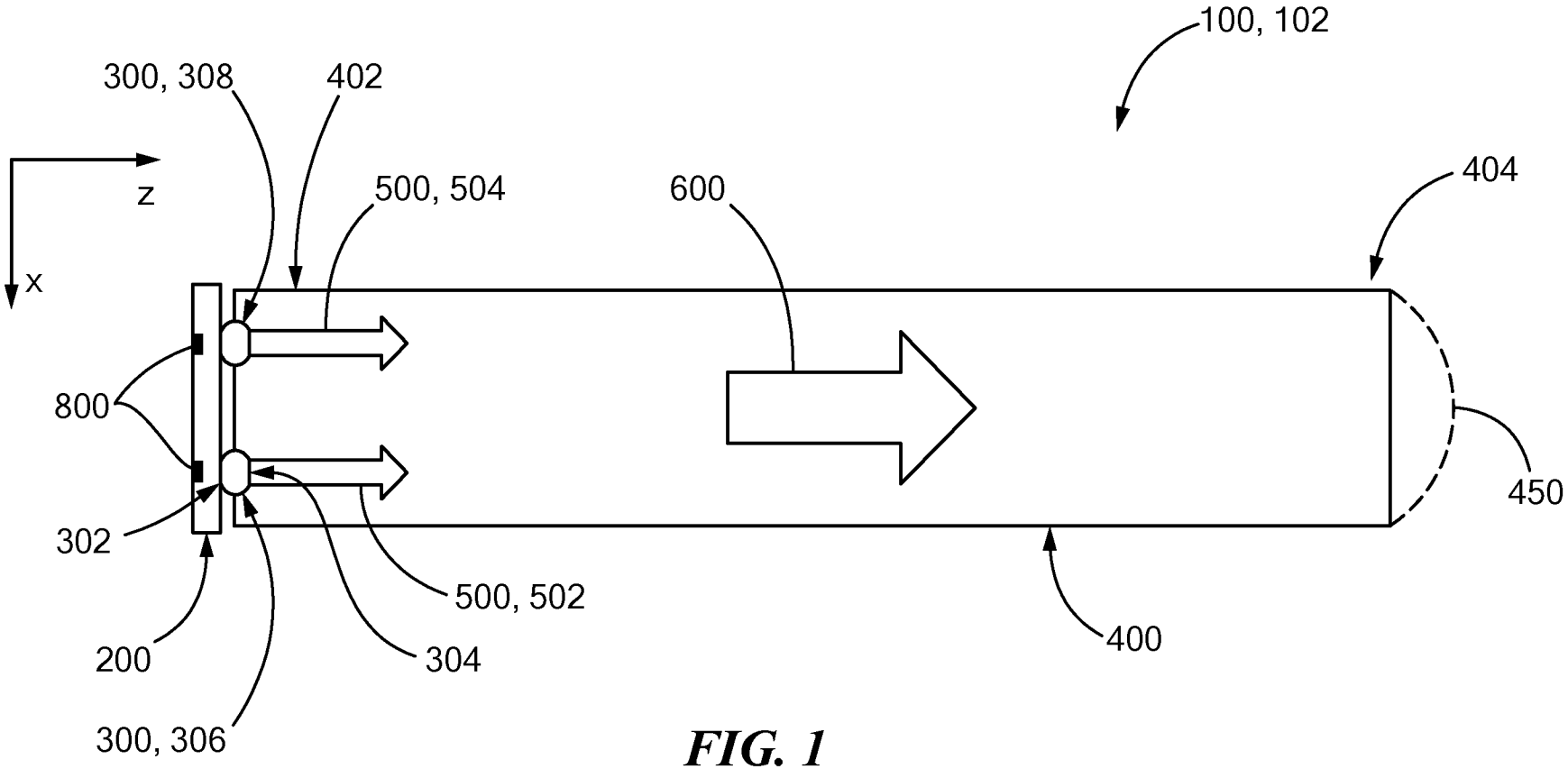
FIG. 1 depicts a block diagram end view of an EM device, in accordance with an embodiment.

FIG. 1 depicts an example EM device 100 having a substrate 200, at least one 1DP 300 disposed on the substrate 200, where in an embodiment the 1DP 300 is a DRA composed of a dielectric material other than air, and at least one 2DP 400 also disposed on the substrate 200, where in an embodiment the 2DP is a DWG composed of a dielectric material other than air, and where the 2DP 400 is adapted, configured, and disposed to be electromagnetically coupled to the 1DP 300 when the 1DP 300 is electromagnetically excited. In an embodiment, the substrate 200 has at least one signal feed 800 (discussed further herein below) disposed and adapted to electromagnetically excite corresponding ones of the at least one 1DP 300. In an embodiment, the 1DP 300, when electromagnetically excited, is adapted, configured, and disposed to radiate an EM signal 500 to the 2DP 400, and the 2DP 400 is adapted, configured, and disposed to propagate a resulting internally transmitted EM signal 600 from a proximate end 402 of the 2DP 400 to a distal end 404 of the 2DP 400. As depicted herein, the directions of EM signals 500 and 600 are intended to be representative of respective directions of maximum radiation. In an embodiment, the 1DP 300 and the 2DP 400 have different three-dimensional, 3D, shapes, which will be discussed further herein below. While the EM signals 500, 600 are depicted in FIG. 1 as originating from the 1DP 300 and propagating from the proximal end 402 to the distal end 404 of the 2DP 400, it will be appreciated by one skilled in the art that this is for illustration purposes of the EM device 100 being configured as a transmit device. In an embodiment where the EM device 100 is configured as a receive device, it will be appreciated by one skilled in the art that the direction of the EM signals 500, 600 will be reversed (which may be illustrated by reversal of the depicted arrow heads, discussed further herein below with reference to FIG. 15). As such, the embodiment depicted in FIG. 1 is representative of both a transmit EM device 100, where the 1DP 300 is configured to provide an EM signal to the 2DP 400, and a receive EM device 100, where the 2DP 400 is configured to provide an EM signal to the 1DP 300. In an embodiment, the 1DP 300 and the 2DP 400 are in direct intimate contact with each other.

As used herein the phrase "composed of a dielectric material other than air" means a dielectric material that may include air, or any other gas suitable for a purpose disclosed herein, but also includes a non-air dielectric medium. In an embodiment, the dielectric material other than air is a dielectric foam.

As used herein the term "direct intimate contact" means contact with no intervening substance or element therebetween, such as when the 2DP 400 is disposed, deposited, printed, or molded directly onto the 1DP 300, for example. In another embodiment, the 1DP 300 and the 2DP 400 are integrally formed to provide a monolithic structure.

As used herein, the phrase integrally formed means a structure formed with material common to the rest of the structure absent material discontinuities from one region of the structure to another, such as a structure produced from a plastic molding process, a 3D printing process, a deposition process, or a machined process, for example. Alternatively, integrally formed means a unitary one-piece indivisible structure.

As used herein the term "monolithic structure" means a structure integrally formed from a single material composition and/or process absent material discontinuities from one region of the structure to another, such as a structure produced from a plastic molding process, a 3D printing process, a deposition process, or a machined process, for example.

In an embodiment, the 1DP 300 has a proximal end 302 disposed proximate the substrate 200, and a distal end 304 disposed a distance from the proximal end 302. In an embodiment, the proximal end 402 of the 2DP 400 is disposed proximate the distal end 304 of the 1DP 300. In an embodiment, the 1DP 300 is an all-dielectric material having a first average dielectric constant, the 2DP 400 is an all-dielectric material having a second average dielectric constant, and the first average dielectric constant is greater than the second average dielectric constant. In an example embodiment the first average dielectric constant is equal or greater than 4 and equal to or less than 18, and the second average dielectric constant is greater than 1 and equal to or less than 9. In an example embodiment: the first average dielectric constant is equal or greater than 4 and equal to or less than 18; and, the second average dielectric constant is greater than 1 and equal to or less than 9. In another example embodiment: the first average dielectric constant is equal to or greater than 5 and equal to or less than 18; and, the second average dielectric constant is greater than 1 and less than 5. In an embodiment, the 1DP 300 and at least a portion of the 2DP 400 are configured to form a DRA, where the 2DP 400 is configured to radiate EM radiation through the distal end 404 of the 2DP 400 when the 1DP 300 is electromagnetically excited.

As depicted in FIG. 1, an embodiment of the EM device 100, more particularly denoted as 102, has a plurality of the 1DP 300, denoted as 306 and 308 for example, and has only a single 2DP 400. In the embodiment of FIG. 1, the single 2DP 400 forms a single DWG, also denoted by reference numeral 400, that is electromagnetically coupled to each of the plurality of the 1DP 306, 308, such that each of the plurality of the 1DP 306, 308 collectively electromagnetically feed the single DWG 400 when the plurality of the 1DP 306, 308 are electromagnetically excited.

From the foregoing, it will be appreciated that reference numeral 100 refers to an EM device generally, that reference numeral 102 refers to a particular example EM device, that reference numeral 300 refers to a 1DP generally, and that reference numerals 306, 308 refer to particular individual ones of the 1DP. A similar usage of reference numerals for other features described herein, such as the 2DP 400 for example, is used herein below. As depicted in FIG. 1, the EM device 102 is configured as a transmit EM device 102, where each 1DP 306, 308 when electromagnetically excited is configured to radiate a corresponding EM signal 502, 504, and the single DWG 400 is configured to receive the EM signals 502, 504 and to propagate them collectively, as depicted by reference numeral 600 for example.

Figure 2:
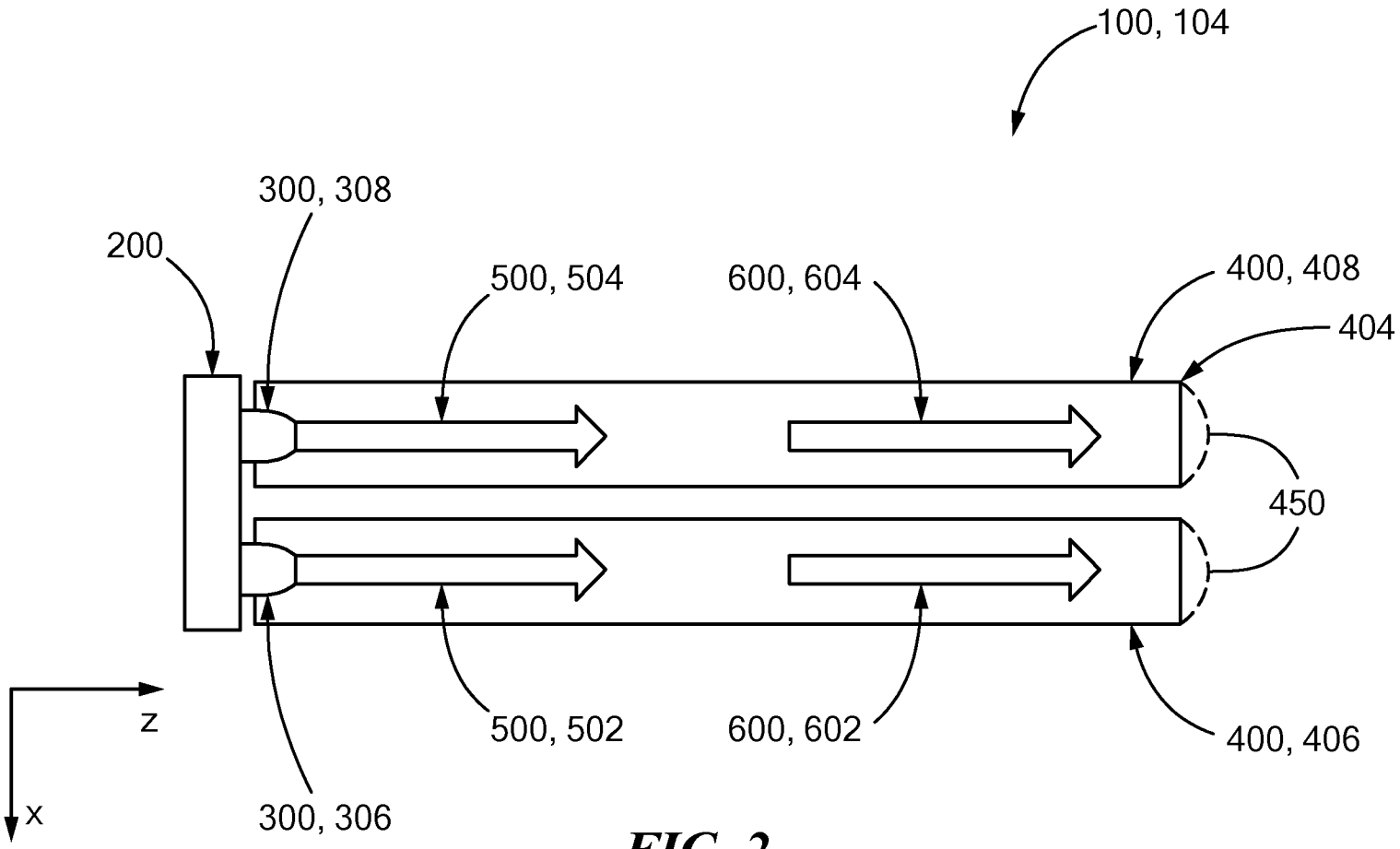
FIG. 2 depicts a block diagram end view of an EM device alternative to that of FIG. 1, in accordance with an embodiment.

Reference is now made to FIG. 2, where an embodiment of the EM device 100, more particularly denoted as 104, has a plurality of the 1DP 306, 308, and has a plurality of the 2DP 400, denoted as 406 and 408. In the embodiment of FIG. 2, the plurality of the 2DP 406, 408 forms a plurality of the DWG, also denoted by reference numerals 406 and 408, wherein each of the plurality of the DWG 406, 408 is electromagnetically coupled to a corresponding one of the plurality of the 1DP 306, 308, such that each of the plurality of the 1DP 306, 308 is disposed to individually electromagnetically feed a corresponding one of the plurality of the DWG 406, 408. As depicted in FIG. 2, the EM device 104 is configured as a transmit EM device 104, where each 1DP 306, 308 when electromagnetically excited is configured to radiate a corresponding EM signal 502, 504, and the plurality of the DWG 406, 408 are configured to receive corresponding ones of the EM signal 502, 504 and to propagate them individually, as depicted by reference numerals 602, 604, respectively.

While FIGS. 1 and 2 depict the distal end 404 of the 2DPs 400, 406, 408 having a flat structure, it will be appreciated that this is for illustration purposes only, and that the distal end 404 of the 2DPs 400, 406, 408, or any other 2DP disclosed herein, may have any shape suitable for a purpose disclosed herein, such as a convex shape as depicted by dashed lines 450 for example.

Figure 3:
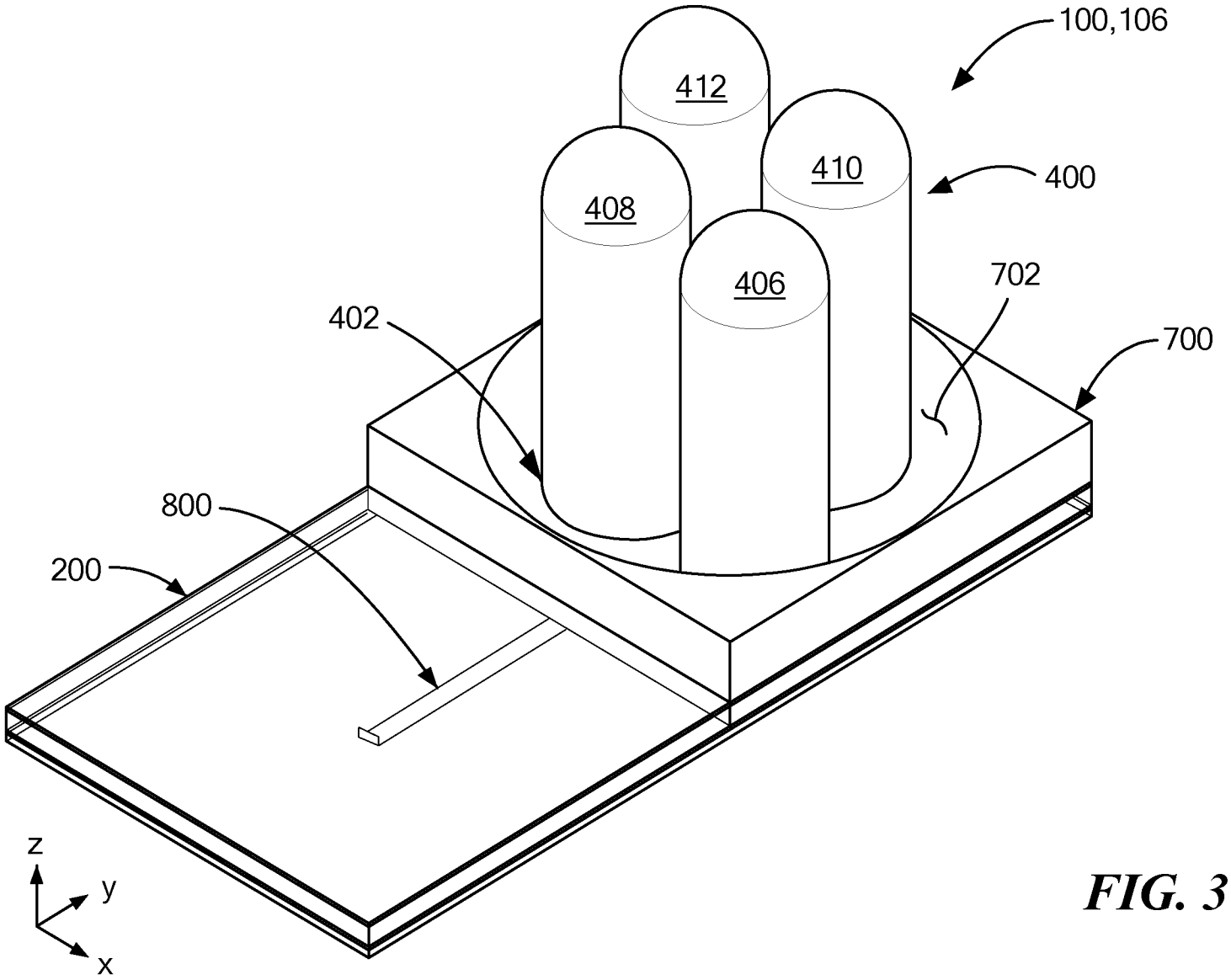
FIG. 3 depicts a solid rotated isometric view of an EM device comparable to that of FIG. 2, in accordance with an embodiment.
Figure 4:
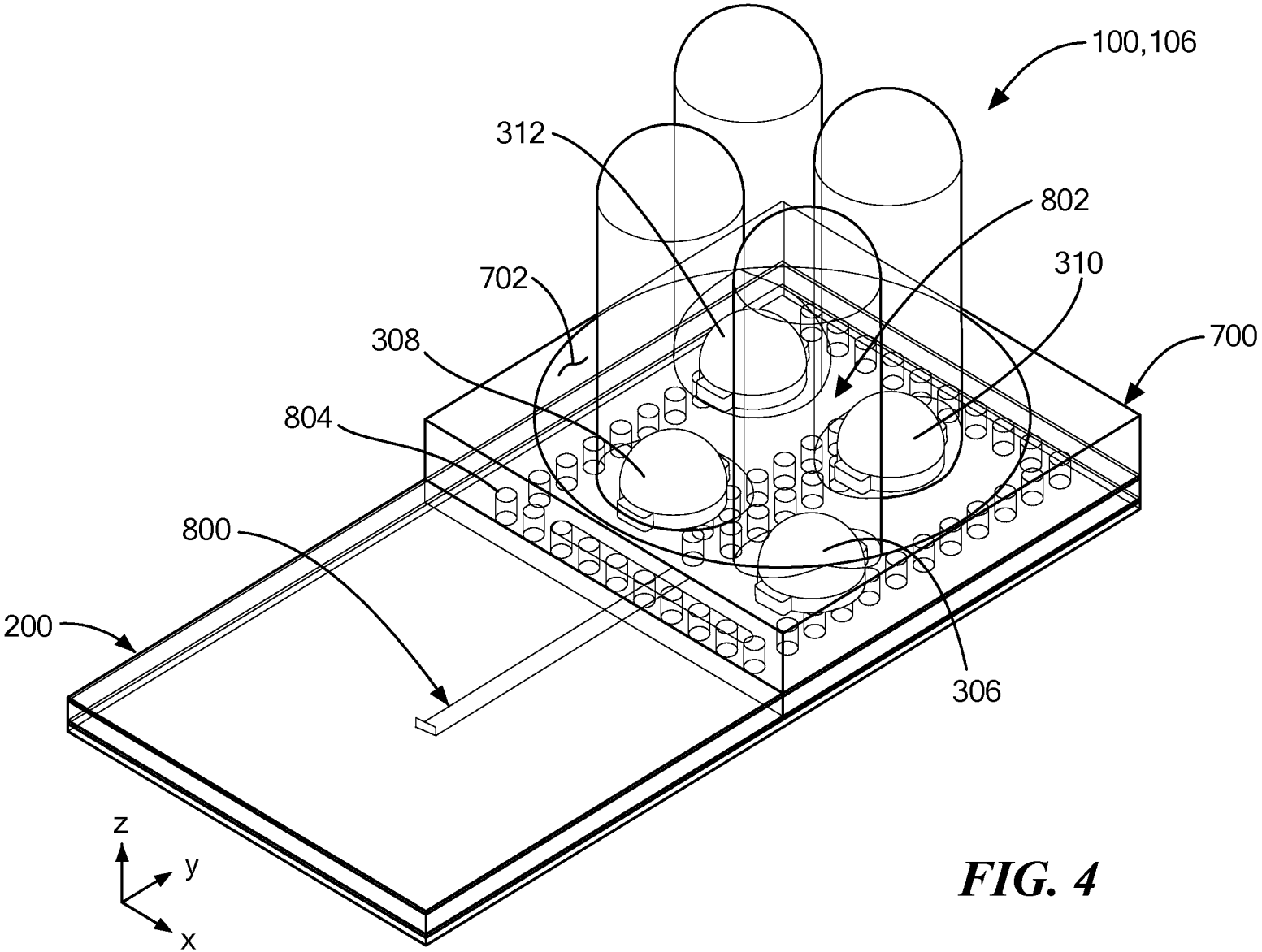
FIG. 4 depicts a transparent rotated isometric view of the EM device of FIG. 3, in accordance with an embodiment.
Figure 5:
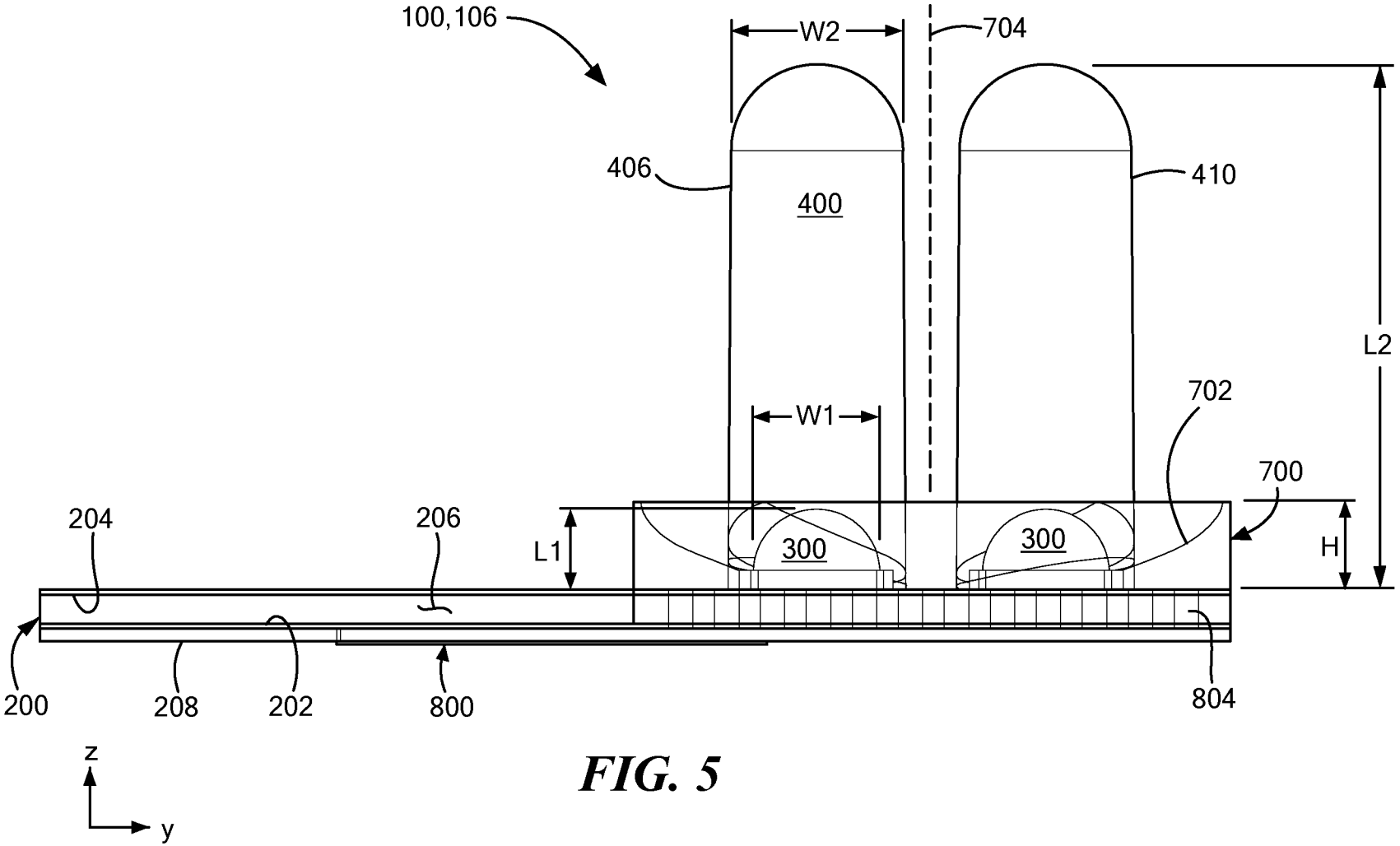
FIG. 5 depicts a transparent side view of the EM device of FIG. 3, in accordance with an embodiment.
Figure 6:
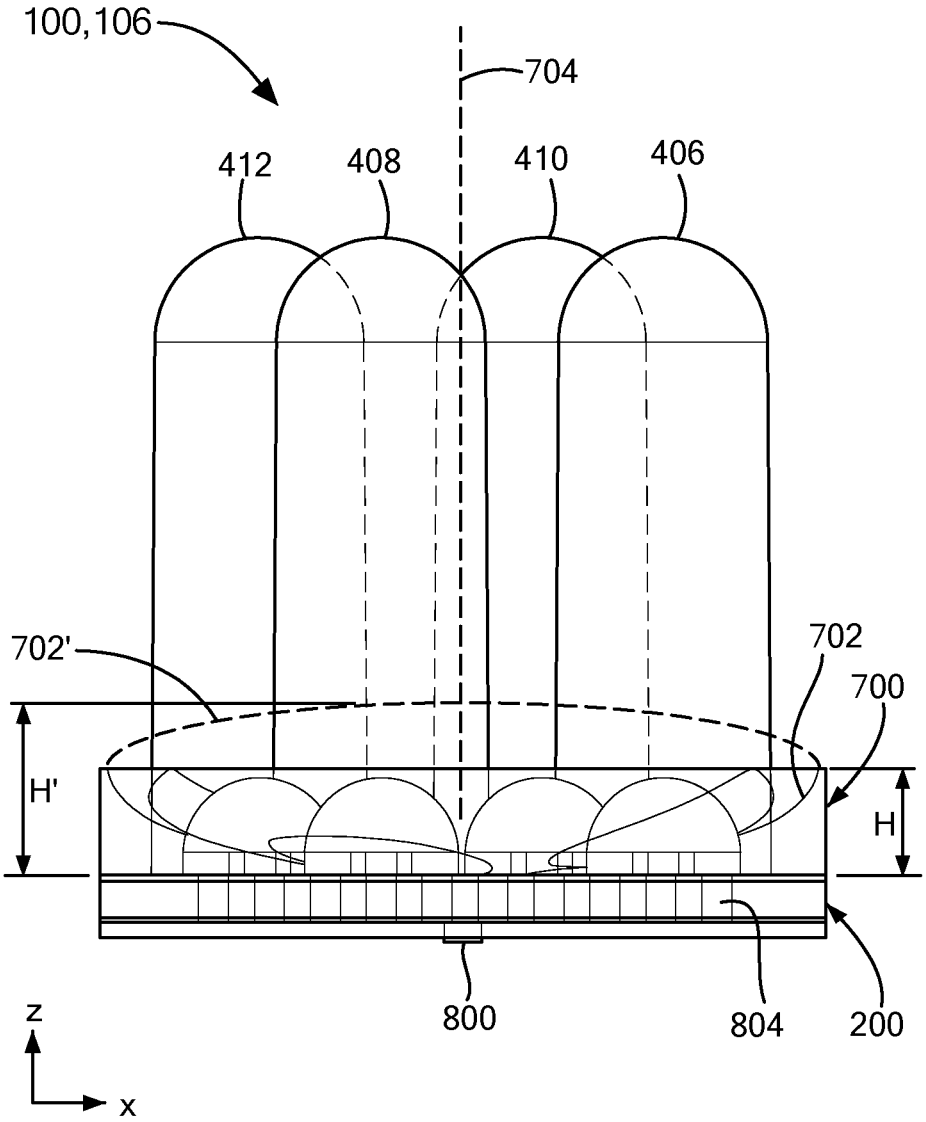
FIG. 6 depicts a transparent end view of the EM device of FIG. 3, in accordance with an embodiment.

While FIGS. 1 and 2 along with the corresponding foregoing descriptions refer to only two of the 1DP 306, 308, it will be appreciated that this is for illustration purposes only, and that the number of the 1DP 300 may be any array size suitable for a purpose disclosed herein. For example, FIGS. 1 and 2 may be considered to be block diagram end views of a 2-by-2 array of DRAs and DWGs, which will now be described with reference to FIGS. 3-6 collectively, where FIG. 3 depicts a rotated isometric solid form view of an EM device 100, more particularly denoted as 106, FIG. 4 depicts a rotated isometric transparent form view of the EM device 106, FIG. 5 depicts a transparent side view of the EM device 106, and FIG. 6 depicts a transparent end view of the EM device 106, where like elements are numbered alike. Notwithstanding the foregoing, it will be appreciated that the illustrated 2×2 array of DRAs and DWGs in at least FIGS. 3-4 are non-limiting, and that the size of an array of DRAs and DWGs as disclosed herein may be any size suitable for a purpose disclosed herein.

In an embodiment, the EM device 106 includes a substrate 200, a 2-by-2 array of four of the 1DP 300, individually denoted as 306, 308, 310 and 312, disposed on the substrate 200, and a corresponding four of the 2DP 400, individually denoted as 406, 408, 410 and 412, disposed relative to the respective 1DPs 306, 308, 310, 312 in an arrangement similar to that described above in connection with FIG. 2. The EM device 106 of FIGS. 3-6 includes some additional features not described in connection with the EM device 104 of FIG. 2, which will now be described.

In an embodiment, the EM device 106 includes a non-metallic all-dielectric structure 700 disposed substantially around a collective grouping of the 1DPs 306, 308, 310, 312, and substantially around a collective grouping of the 2DPs 406, 408, 410, 412, and is disposed at the proximal end 402 of the 2DPs 406, 408, 410, 412. In an embodiment, the non-metallic all-dielectric structure 700 has a curved surface 702 having a focal point substantially coincidental with a geometrical axial center of the collective grouping of the 1DPs 306, 308, 310, 312, as depicted by reference numeral 704 in FIGS. 5 and 6. As used herein, the term "substantially coincidental" means coincidental within a predetermined acceptable manufacturing tolerance of the assembled structure. As depicted in FIGS. 3-6, the curved surface 702 has a concave-up shape relative to a z-axis of the EM device 106. In an alternative embodiment, the curved surface 702' has a concave-down shape, as depicted by dashed lines in FIG. 6 for example. In an embodiment, the non-metallic all-dielectric structure 700 is an all-dielectric material having the first average dielectric constant and is integrally formed with and monolithic with the at least one 1DP 300. In another embodiment, the non-metallic all-dielectric structure 700 is an all-dielectric material having the second average dielectric constant and is integrally formed with and monolithic with the at least one 2DP 400. In an embodiment, the non-metallic all-dielectric structure 700 has an overall height, H, H', as observed in an elevation view of the EM device 100 (see FIGS. 5 and 6 for example).

In an embodiment, the EM device 106 having the non-metallic all-dielectric structure 700 as disclosed herein, provides an arrangement where the 2DPs 406, 408, 410, 412 are absent any surrounding metallic cavity wall in close proximity to the 2DPs 406, 408, 410, 412 that would, if present, have an effect on the electromagnetic characteristics of the EM device 106.

In an embodiment, analytical modeling of the EM device 106 having the non-metallic all-dielectric structure 700 as disclosed herein, has demonstrated an improvement in radiated signal gain of 0.5-0.7 dBi, as compared to a similar EM device but absent the non-metallic all-dielectric structure 700.

In an embodiment, the at least one 1DP 300 has a first overall width dimension W1, as observed in an elevation or rotated isometric view (see representative FIG. 5 for example), orthogonal to a z-axis of the EM device 100, and the at least one 2DP 400 has a second overall width dimension W2, as observed in an elevation or rotated isometric view (see representative FIG. 5 for example), orthogonal to the z-axis of the EM device 100, where W2 is equal to or greater than W1. In an embodiment, W2 is greater than W1.

In an embodiment, the at least one 1DP 300 has a first overall length dimension L1, as observed in an elevation or rotated isometric view (see representative FIG. 5 for example), parallel to a z-axis of the EM device 100, and the at least one 2DP 400 has a second overall length dimension L2, as observed in an elevation or rotated isometric view (see representative FIG. 5 for example), parallel to the z-axis of the EM device 100, where L2 is greater than L1. In an embodiment, L2 is greater than 10 times L1, alternatively L2 is greater than 15 times L1, alternatively, L2 is greater than 20 times L1, alternatively L2 is equal to or greater than 20 times λ, where λ is an operating wavelength of the EM radiation field originating from the at least one 1DP 300 when the at least one 1DP 300 is electromagnetically excited, alternatively L2 is equal to or greater than 30 times λ, alternatively L2 is equal to or greater than 40 times λ.

In an embodiment, the overall height H, H' of the non-metallic all-dielectric structure 700 is greater than L1 and less than L2. In an embodiment, H, H' is greater than L1 and equal to or less than 1.5 times L1. In an embodiment, H, H' is greater than L1 and equal to or less than 1.2 times L1.

In an embodiment and with reference to FIGS. 3-6, the substrate 200 has at least one signal feed 800 disposed and adapted to electromagnetically excite the at least one 1DP 300. As depicted in FIGS. 3-6, the signal feed 800 is a substrate integrated waveguide (SIW) 802 (best seen generally with reference to FIG. 4), where the substrate 200 is formed from a lower electrically conductive layer 202, an upper electrically conductive layer 204, and a dielectric medium 206 disposed therebetween, and the SIW 802 is formed by way of a plurality of electrically conductive vias 804 that are strategically arranged and are electrically connected, in a known manner, to the lower and upper conductive layers 202, 204. The signal feed 800 is electrically isolated from the lower conductive 202 by way of an intervening dielectric layer 208. A slotted aperture in the form of an opening in the upper conductive layer 204 (not specifically depicted for reasons relating to clarity of the illustration, but well known in the art) is provided to permit signal injection into the SIW 802. In an embodiment, the at least one signal feed 800 is a single signal feed disposed and adapted to electromagnetically excite each of the at least one 1DP 300.

Figure 7A:
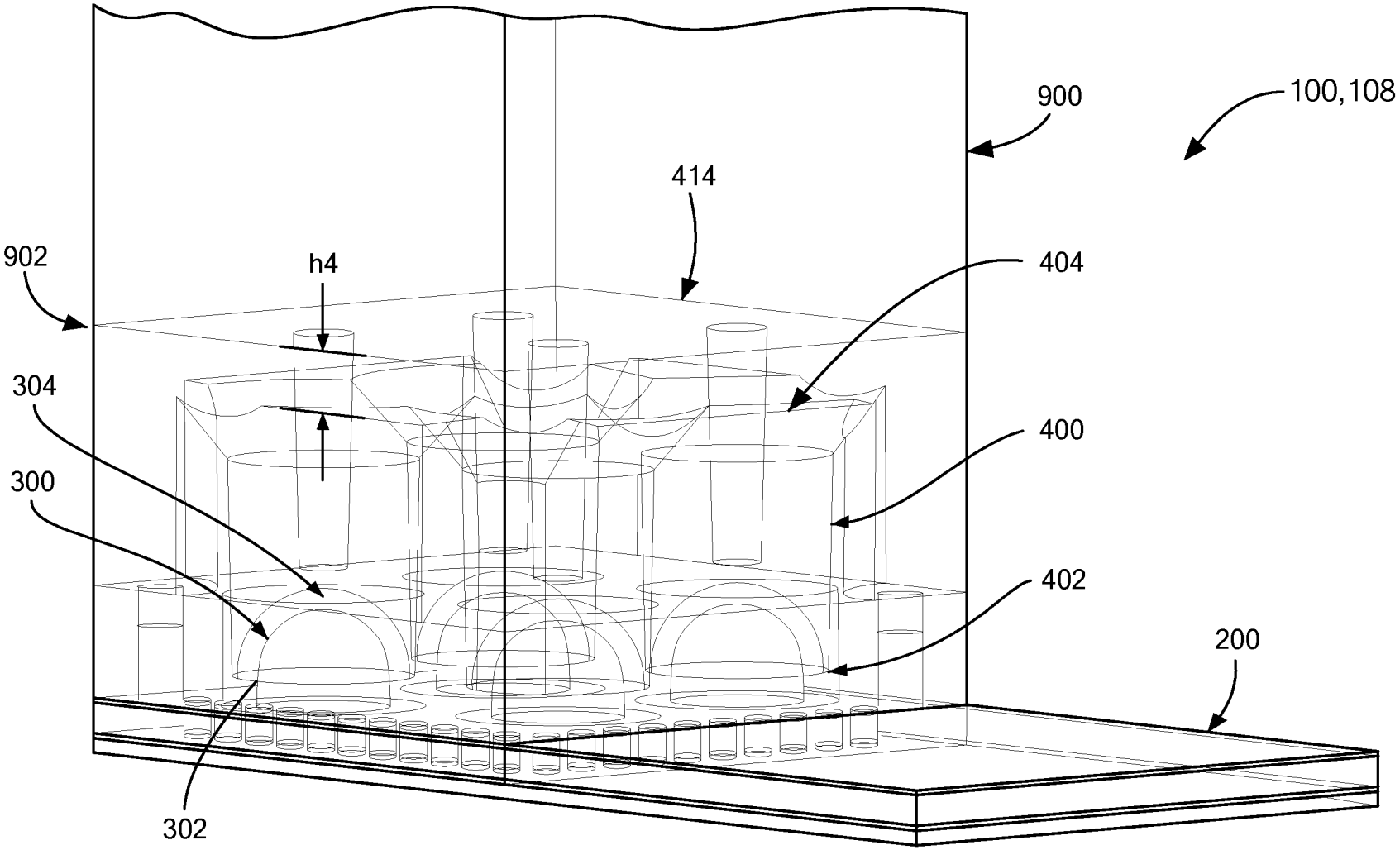
FIGS. 7A and 7B depict partial transparent rotated isometric views of an EM device alternative to that of FIG. 4, in accordance with an embodiment.
Figure 7B:
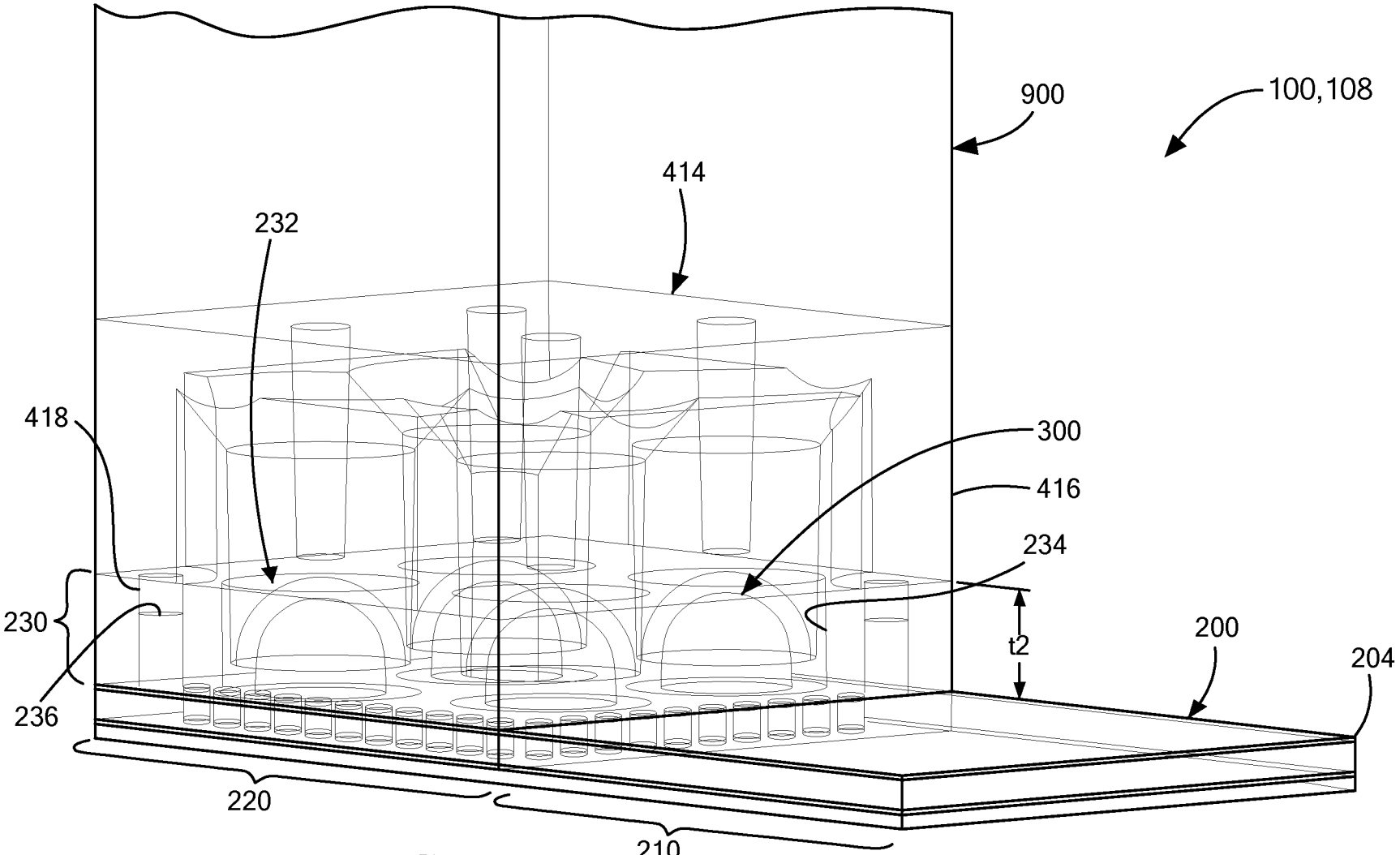
Figure 8:
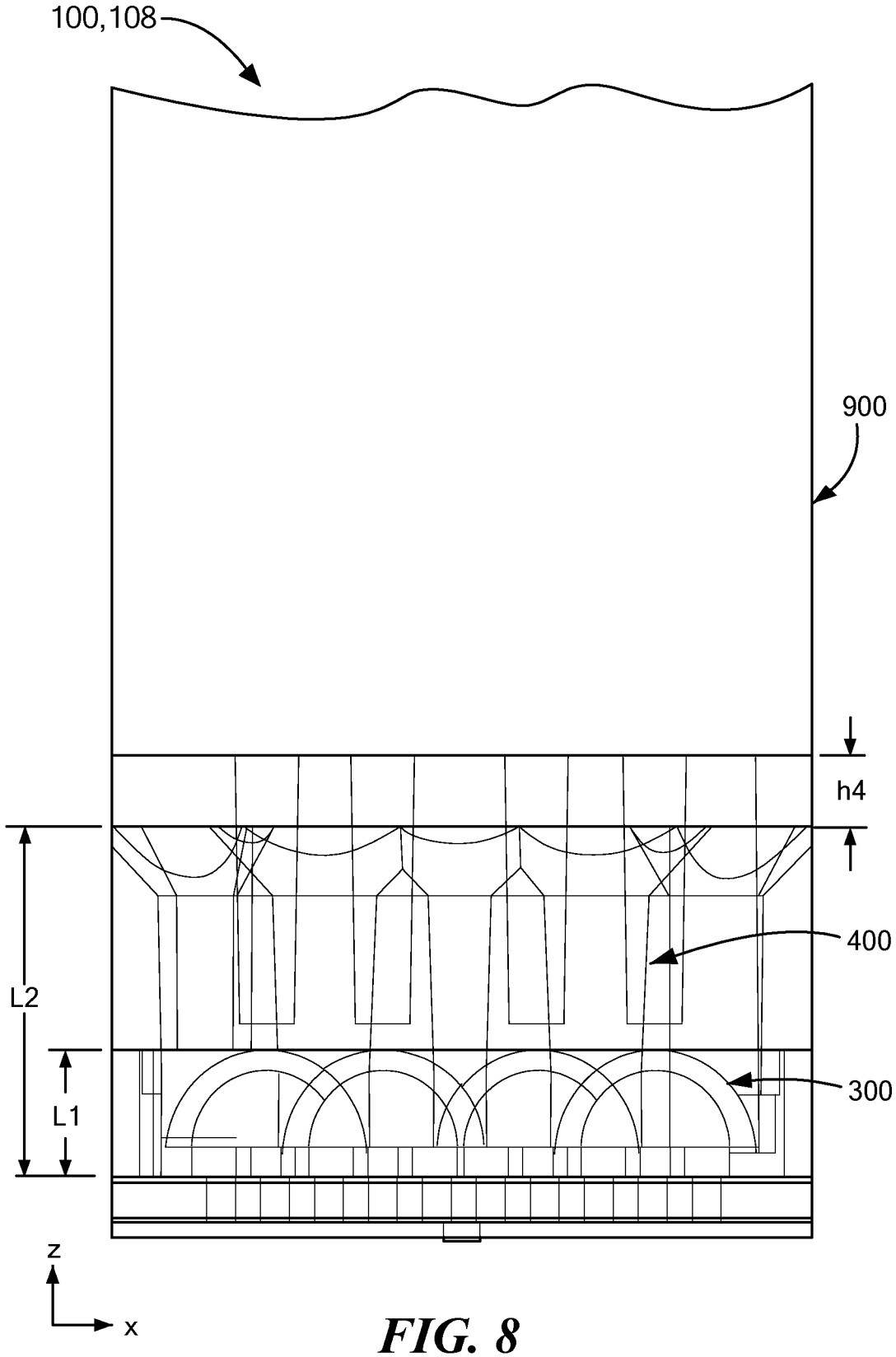
FIG. 8 depicts a partial transparent end view of the EM device of FIGS. 7A and 7B, in accordance with an embodiment.
Figures 9, 10, 11:
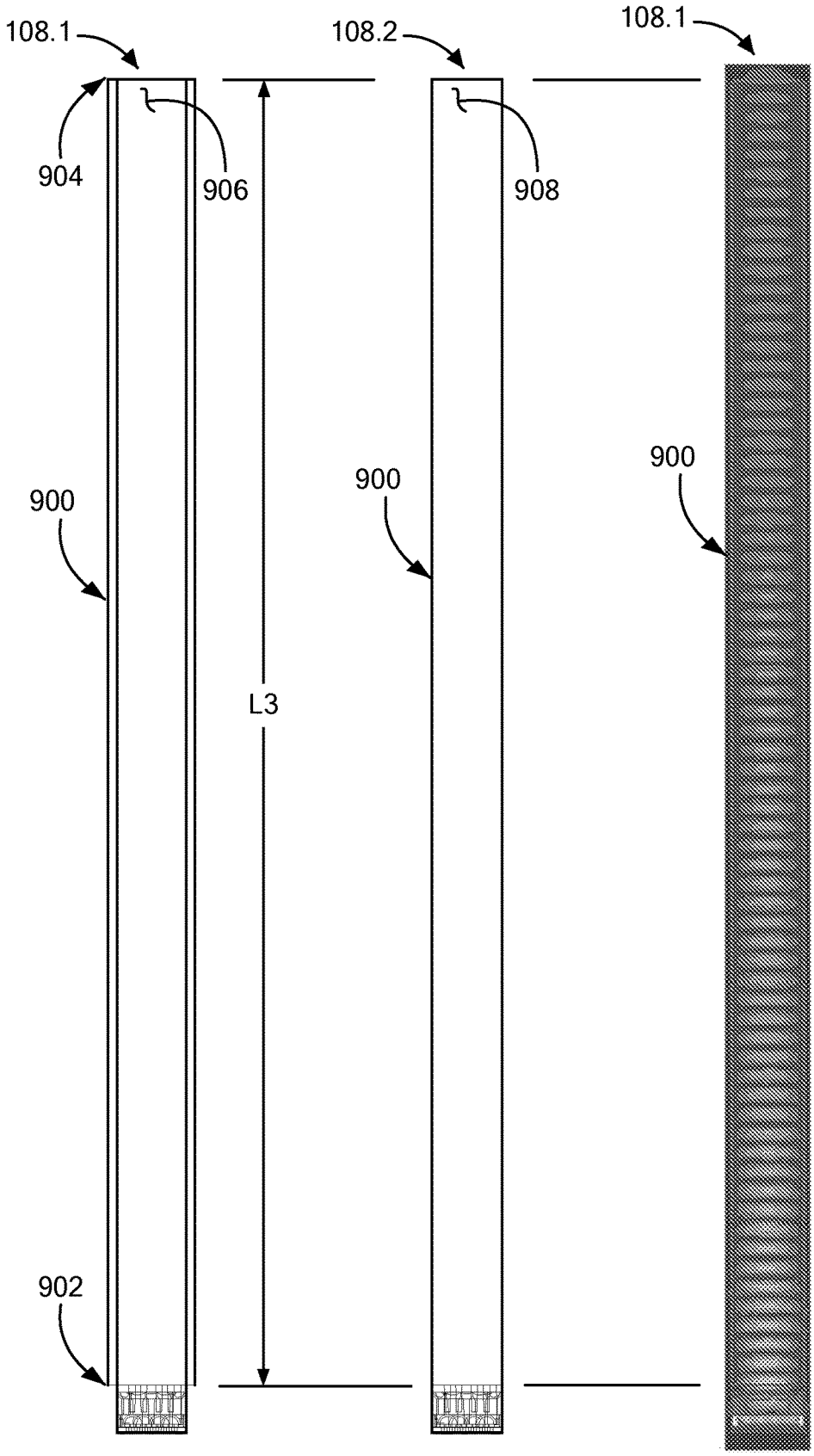
FIG. 9 depicts a complete transparent end view of a first version of the EM device of FIG. 8, in accordance with an embodiment.
FIG. 10 depicts a complete transparent end view of a second version of the EM device of FIG. 8, in accordance with an embodiment.
FIG. 11 depicts analytical modeling results of the EM device of FIG. 9, in accordance with an embodiment.

Reference is now made to FIGS. 7A-11, where FIG. 7A depicts a partial rotated isometric transparent form view of the EM device 108, FIG. 7B depicts the EM device 108 of FIG. 7A but with alternative reference labeling that is discussed further below, FIG. 8 depicts a partial transparent end view of the EM device 108, FIG. 9 depicts a full transparent end view of the EM device 108 as a first version 108.1 of EM device 108, FIG. 10 depicts a full transparent end view of the EM device 108 as a second version 108.2 of EM device 108, and FIG. 11 depicts analytical modeling results of the EM device 108.1 of FIG. 9 depicting the internal propagation of a resulting EM wave that will be discussed below. In general, FIGS. 7A and 8 primarily differ from FIGS. 9-11 in the form of scale, and in how much of a third dielectric portion, 3DP, is illustrated, which will now be discussed in more detail.

A comparison of FIG. 7A with FIG. 4 will show some similarities between the EM devices 108 and 106, respectively, where like elements are numbered alike, along with some dissimilarities that will now be discussed in more detail.

In an embodiment, the EM device 108 of FIG. 7A includes a substrate 200, at least one 1DP 300 disposed on the substrate 200, where in an embodiment the 1DP 300 is a DRA composed of a dielectric material other than air, at least one 2DP 400 composed of a dielectric material other than air, and at least one third dielectric portion, 3DP, 900 composed of a dielectric material other than air. In an embodiment, each one of the at least one 2DP 400 is disposed in a one-to-one correspondence with a given single 1DP 300. The at least one 1DP 300 has a proximal end 302 disposed on the substrate 200, and a distal end 304. The at least one 2DP 400 has a proximal end 402 and a distal end 404, where the proximal end 402 of a given 2DP 400 is disposed proximate the distal end 304 of a corresponding 1DP 300. The at least one 3DP 900 has a proximal end 902 and a distal end 904 (best seen with reference to FIG. 9), the proximal end 902 of a given 3DP 900 being disposed proximate the distal end 404 of a corresponding 2DP 400. In an embodiment, the at least one 3DP 900 is a single 3DP 900 where the proximal end 902 of the single 3DP 900 is disposed proximate the distal end 404 of each of the at least one 2DP 400. In an embodiment, the at least one 3DP 900 (multiple or single) forms a DWG adapted for internal transmission of an EM radiation field originating from the at least one 1DP 300 when the at least one 1DP 300 is electromagnetically excited. In an embodiment, each of the at least one 2DP 400 is integrally connected with each other via a relatively thin connecting structure (connection) 414 disposed proximate the distal end 404 of the at least one 2DP 400, where the relatively thin connecting structure 414 has a height thickness "h4" that is less than the overall length "L2" (see FIG. 5 for example) of a corresponding 2DP 400. In an embodiment, the relatively thin connecting structure 414 and each of the at least one 2DP 400 form a monolithic structure. In an embodiment, the DWG formed by the at least one 3DP 900 is absent any surrounding metallic cavity wall in close proximity to the 3DP 900 that would, if present, have an effect on the electromagnetic characteristics of the EM device 108.

In an embodiment and with reference to FIGS. 8 and 9, the at least one 1DP 300 has a first length dimension L1, as observed in an elevation or rotated isometric view, parallel to a z-axis of the EM device 108, the at least one 2DP 400 has a second length dimension L2, as observed in an elevation or rotated isometric view, parallel to the z-axis of the EM device 108, and the at least one 3DP 900 has a third length dimension L3, as observed in an elevation or rotated isometric view, parallel to the z-axis of the EM device 108, where L2 is greater than L1, and L3 is greater than L2. In an embodiment, L3 is greater than 10 times L2, alternatively L3 is greater than 15 times L2, further alternatively L3 is greater than 20 times L2. In an embodiment, L3 is equal to or greater than 20 times λ, where λ is an operating wavelength of the EM radiation field originating from the at least one 1DP 300 when the at least one 1DP 300 is electromagnetically excited, alternatively L3 is equal to or greater than 30 times k, further alternatively L3 is equal to or greater than 40 times λ.

In an embodiment, the at least one 2DP 400 forms in combination an EM beam shaper (a lens for example) and a DWG, where the EM beam shaper and DWG combination is adapted for internal transmission and radiation of the EM radiation field originating from the at least one 1DP 300 to the at least one 3DP 900.

In an embodiment, the at least one 3DP 900 has a hollow interior portion 906, as depicted in FIG. 9. In an alternative embodiment, the at least one 3DP 900 has a solid interior portion 908, as depicted in FIG. 10. The at least on 3DP 900 depicted in FIG. 11 has a hollow interior portion 906, and has a length L3 that is on the order of 30-40 times λ.

In an embodiment, the at least one 1DP 300 is an all-dielectric material having a first average dielectric constant, the at least one 2DP 400 is an all-dielectric material having a second average dielectric constant, the at least one 3DP 900 is an all-dielectric material having a third average dielectric constant, the first average dielectric constant is greater than the second average dielectric constant, and the second average dielectric constant is equal to or greater than the third average dielectric constant. In an embodiment, second average dielectric constant is greater than the third average dielectric constant. In an embodiment, the first average dielectric constant is equal to or greater than 4 and equal to or less than 18. In an embodiment, the second average dielectric constant is equal to or greater than 3 and equal to or less than 9. In an embodiment, the third average dielectric constant is greater than 1 and equal to or less than 5. In an embodiment: the first average dielectric constant is equal to or greater than 4 and equal to or less than 18; the second average dielectric constant is equal to or greater than 3 and equal to or less than 9; and, the third average dielectric constant is greater than 1 and equal to or less than 5.

Reference is now made to FIG. 7B, which depicts the EM device 108 of FIG. 7A, but with alternative reference labeling for illustrating alternative features that will now be described. In an embodiment, the substrate 200 has a first portion 210, and a second portion 220 that is contiguous with and in electrical communication with the first portion 210. The first portion 210 includes the at least one signal feed 800 (best seen with reference to FIG. 3) that is disposed and adapted to electromagnetically excite the at least one 1DP 300, as described herein above. As with the substrate 200 of FIGS. 3-6, an upper conductive layer 204 extends across both the first and the second portions 210, 220. In an embodiment, the second portion 220 includes an extended structure 230 that is disposed on, is electrically connected with, and extends a thickness t2 above the upper conductive layer 204 of the second portion 220. The extended structure 230 includes a plurality of pockets 232 in which corresponding ones of the at least one 1DP 300 are disposed, where the sidewall 234 of a given pocket 232 surrounds the corresponding 1DP 300. In an embodiment, the thickness t2 is equal to or slightly greater than the length L1 of the 1DP 300 (see L1 depicted in FIGS. 5 and 8 for example). In an embodiment, the relatively thin connecting structure 414 has a plurality of integrally formed columns 416 that extend down to engage with the extended structure 230, which serves to support the at least one 2DP 400, along with the relatively thin connecting structure 414. In an embodiment, each column 416 has an integrally formed projection or pin 418 on an end thereof that engages with a corresponding pocket 236 of the extended structure 230, which serves to align the at least one 2DP 400 relative to corresponding ones of the at least one 1DP 300.

In a first embodiment of the EM device 108, the extended structure 230 is made from an electrically conductive material that is disposed in electrical communication with the upper conductive layer 204, and the sidewalls 234 of the pockets 232 form corresponding electrically conductive reflectors that surround individually ones of the at least one 1DP 300.

In a second alternative embodiment of the EM device 108, the extended structure 230 is made from a dielectric material that is disposed on the upper conductive layer 204, and the sidewalls 234 of the pockets 232 form corresponding dielectric reflectors that surround individually ones of the at least one 1DP 300. In the second alternative embodiment of the EM device 108, the dielectric material of the extended structure 230 may have a fourth average dielectric constant that is equal to or less than the first average dielectric constant of the 1DP 300, and that is equal to or greater than the second average dielectric constant of the 2DP 400.

In an embodiment, and with reference to FIGS. 7A and 7B in combination, the proximal end 402 of each 2DP 400 may extend into a corresponding pocket 232 of the extended structure 230, such that the corresponding sidewall 234 of a given pocket 232 also surrounds the proximal end 402 of a corresponding 2DP 400.

Reference is now made to FIGS. 12-15, which depict alternative embodiments of EM devices 100.

Figure 12:
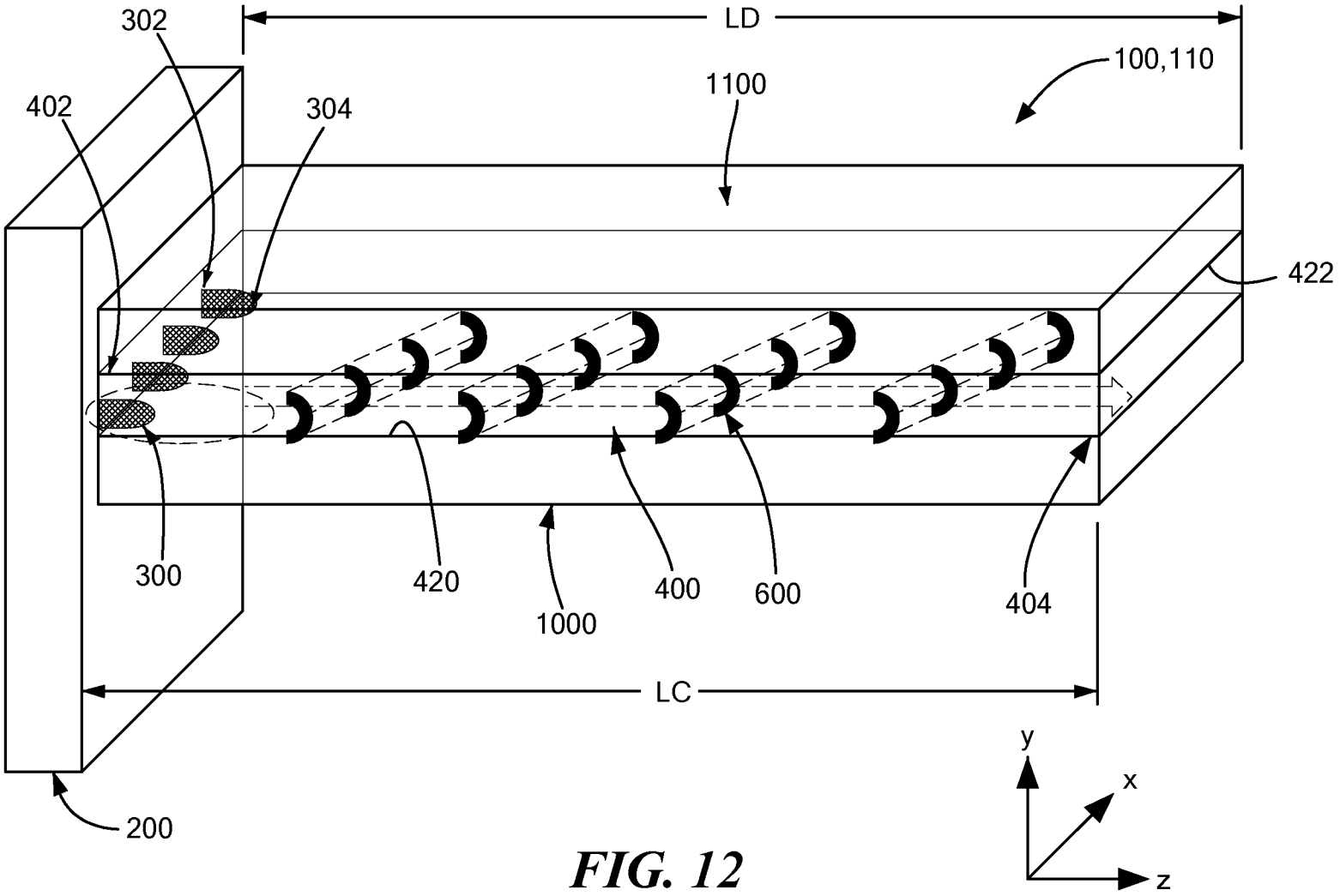
FIGS. 12, 13, 14, and 15, depict transparent rotated isometric views of an EM device alternative to that of FIG. 1, in accordance with an embodiment.

FIG. 12 depicts an EM device, generally enumerated by reference numeral 100 and particularly enumerated by reference numeral 110, having a substrate 200, at least one 1DP 300 having a proximal end 302 and a distal end 304, and at least one 2DP 400 having a proximal end 402 and a distal end 404. Each of the at least one 1DP 300 is made of a dielectric material other than air, and each of the at least one 2DP 400 is made of a dielectric material other than air. The proximal end 302 of each 1DP 300 is disposed on the substrate 200 and each of the at least one 1DP 300 extends substantially perpendicular to the substrate 200 in a lengthwise direction parallel to a z-axis of the EM device 110. The proximal end 402 of a given 2DP 400 is disposed proximate the distal end 304 of a corresponding 1DP 300, and each of the at least one 2DP 400 is disposed on the substrate 200 and extends substantially perpendicular to the substrate 200 in a lengthwise direction parallel to the z-axis of the EM device 110. In an embodiment, the at least one 2DP 400 forms a DWG that is adapted and configured for internal transmission of an EM radiation field, EM signal, 600 originating from the at least one 1DP 300 when the at least one 1DP 300 is electromagnetically excited. A third dielectric portion, 3DP, 1000 (structurally and functionally different from the 3DP 900 depicted in FIGS. 7A-11) is disposed sideways adjacent to and on a first side 420 of the at least one 2DP 400, and a fourth dielectric portion, 4DP, 1100 is disposed sideways adjacent to and on a second side 422 opposite the first side 420 of the at least one 2DP 400. In an embodiment, the 3DP 1000, the at least one 2DP 400, and the 4DP 1100, form a laminate. The 3DP 1000 is made of a dielectric material other than air, and the 4DP 1100 is made of a dielectric material other than air. The 3DP 1000 is disposed on the substrate 200 and extends substantially perpendicular to the substrate 200 in a lengthwise direction parallel to the z-axis of the EM device 110, and the 4DP 1100 is disposed on the substrate 200 and extends substantially perpendicular to the substrate 200 in a lengthwise direction parallel to the z-axis of the EM device 110. In an embodiment, the at least one 1DP 300 is an all-dielectric material having a first average dielectric constant, the at least one 2DP 400 is an all-dielectric material having a second average dielectric constant, the 3DP 1000 is an all-dielectric material having a third average dielectric constant, and the 4DP 1100 is an all-dielectric material having a fourth average dielectric constant, where the first average dielectric constant is greater than the second average dielectric constant, the second average dielectric constant is greater than the third average dielectric constant, and the second average dielectric constant is greater than the fourth average dielectric constant. In an embodiment, the third average dielectric constant is equal to the fourth average dielectric constant. In an embodiment, the first average dielectric constant is equal to or greater than 4 and equal to or less than 18. In an embodiment, the second average dielectric constant is equal to or greater than 3 and equal to or less than 9. In an embodiment, the third average dielectric constant is equal to or greater than 2 and equal to or less than 5. In an embodiment, the fourth dielectric constant is equal to or greater than 2 and equal to or less than 5. In an embodiment: the first average dielectric constant is equal to or greater than 4 and equal to or less than 18; the second average dielectric constant is equal to or greater than 3 and equal to or less than 9; the third average dielectric constant is equal to or greater than 2 and equal to or less than 5; and, the fourth dielectric constant is equal to or greater than 2 and equal to or less than 5. In an embodiment, the fourth average dielectric constant is equal to the third average dielectric constant. In an embodiment, the at least one 1DP 300 has a first length dimension L1, as observed in an elevation or rotated isometric view, parallel to a z-axis of the device (refer to L1 as depicted in FIG. 5 for example), the at least one 2DP 400 has a second length dimension L2, as observed in an elevation or rotated isometric view, parallel to the z-axis of the EM device 110 (refer to L2 as depicted in FIG. 5 for example), the 3DP 1000 has a third length dimension LC, as observed in an elevation or rotated isometric view, parallel to the z-axis of the EM device 110 (see FIG. 12 for example), the 4DP 1100 has a fourth length dimension LD, as observed in an elevation or rotated isometric view, parallel to the z-axis of the EM device 110 (see FIG. 12 for example), and L2, LC, and LD, are each greater than L1. In an embodiment, L2, LC, and LD, are equal to each other. Alternatively, L2, LC, and LD, are each greater than 10 times L1. Further alternatively, L2, LC, and LD, are each greater than 15 times L1. Yet further alternatively, L2, LC, and LD, are each greater than 20 times L1. In an embodiment, L2, LC, and LD, are each equal to or greater than 20 times λ, where λ is an operating wavelength of the EM radiation field originating from the at least one 1DP 300 when the at least one 1DP 300 is electromagnetically excited. Alternatively, L2, LC, and LD, are each equal to or greater than 30 times λ. Further alternatively, L2, LC, and LD are each equal to or greater than 40 times λ. In an embodiment, the substrate 200 is a printed circuit board. In another embodiment, the substrate 200 is a flexible substrate.

Figure 13:
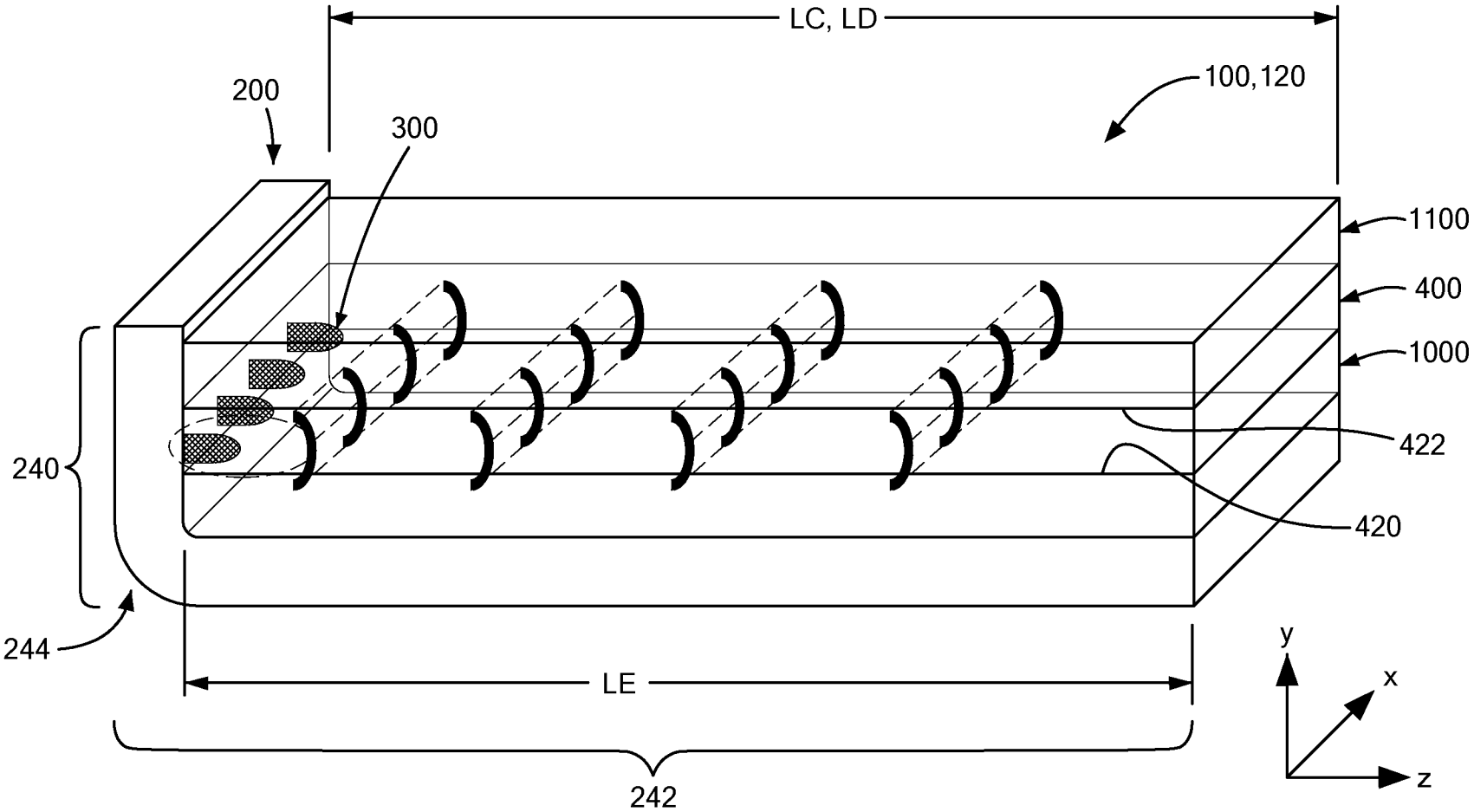

FIG. 13 depicts an EM device, generally enumerated by reference numeral 100 and particularly enumerated by reference numeral 120, similar to the EM device 110 depicted in FIG. 12, but with some differences that will now be described. In an embodiment, the EM device 120 includes a substrate 200 that has a first substrate portion 240, and a second substrate portion 242 that is integral with and forms a contiguity with the first substrate portion 240. In an embodiment the contiguity that forms the first substrate portion 240 and the second substrate portion 242 is a single element, such as a flexible electrical circuit (flex circuit) for example, with a bent portion, or a fold line, 244 between the first and second substrate portions 240, 242. As depicted in FIG. 13, the EM device 120 is configured such that at least one 1DP 300 is disposed on the first substrate portion 240 and extends substantially perpendicular to the first substrate portion 240 in a lengthwise direction parallel to the z-axis of the EM device 120, at least one 2DP 400 is disposed on the first substrate portion 240 and extends substantially perpendicular to the first substrate portion 240 in a lengthwise direction parallel to the z-axis of the EM device 120, a 3DP 1000 is disposed substantially parallel with and adjacent to the second substrate portion 242, and a 4DP 1100 is disposed substantially parallel with and not adjacent to the second substrate portion 242. Similar to EM device 110, the 3DP 1000 of EM device 120 is disposed sideways adjacent to and on a first side 420 of the at least one 2DP 400, and the 4DP 1100 of EM device 120 is disposed sideways adjacent to and on a second side 422 opposite the first side 420 of the at least one 2DP 400. In an embodiment, the second substrate portion 242, the 3DP 1000, the at least one 2DP 400, and the 4DP 1100, form a laminate. As will be appreciated by use of like reference numerals to describe like elements, the structural and material characteristics for certain elements described above in connection with EM device 110 also apply to like elements as described herein in connection with EM device 120, such as lengths L1, L2, LC and LD, and the aforementioned average dielectric constants, for example. In an embodiment, the second substrate portion 242 has a length LE that is equal to L2, LC and LD.

Figure 14:
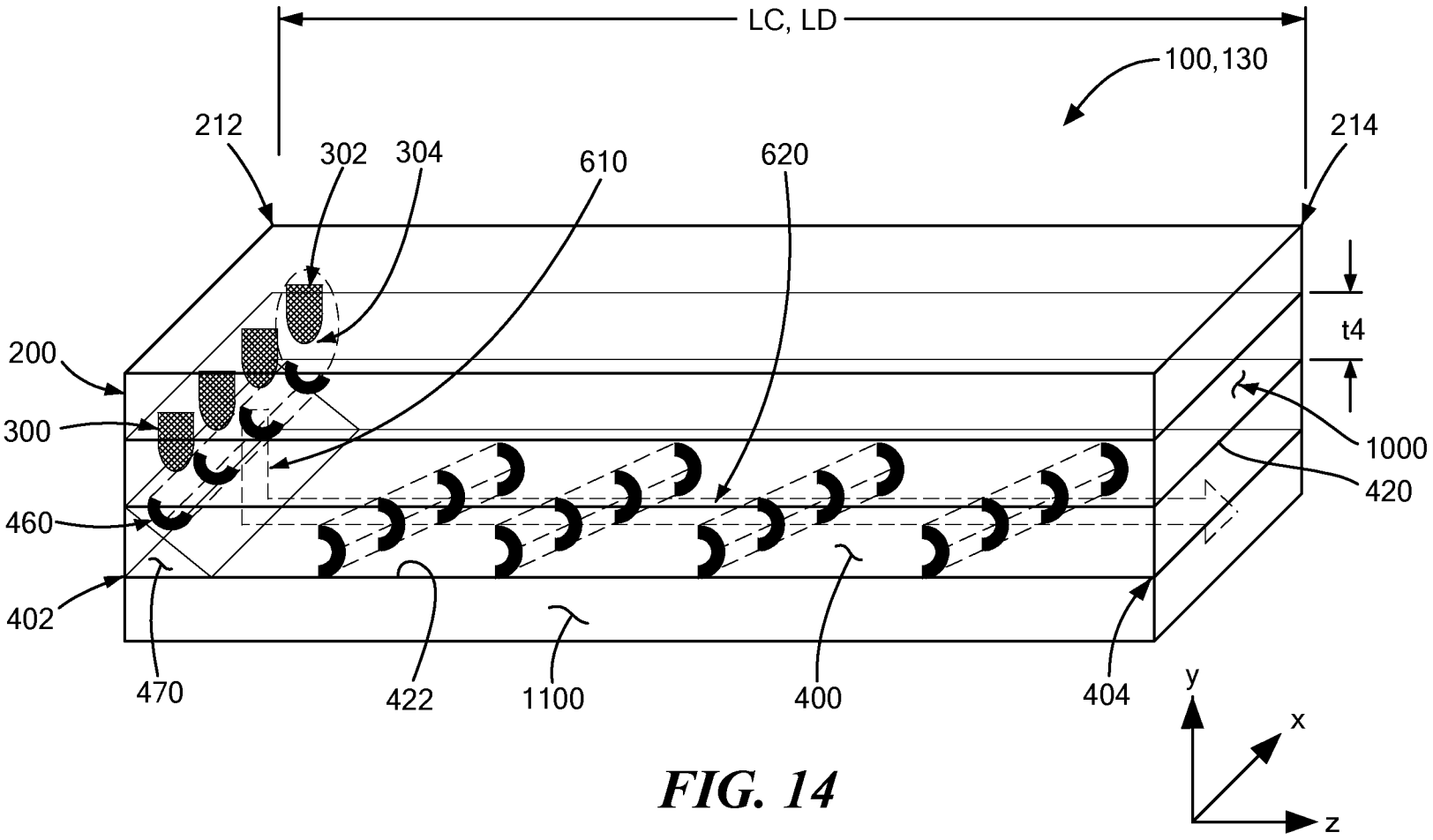

FIG. 14 depicts an EM device, generally enumerated by reference numeral 100 and particularly enumerated by reference numeral 130, similar to the EM device 110 depicted in FIG. 12, but with some differences that will now be described. In an embodiment, the EM device 130 includes: a substrate 200, at least one 1DP 300 having a proximal end 302 and a distal end 304, each of the at least one 1DP 300 being made of a dielectric material other than air, where the proximal end 302 of the at least one 1DP 300 is disposed on the substrate 200 and extends substantially perpendicular to the substrate 200 in a lengthwise direction parallel to the negative-y-axis of the EM device 130; at least one 2DP 400 having a proximal end 402 and a distal end 404, where the proximal end 402 of a given 2DP 400 is disposed proximate the distal end 304 of a corresponding 1DP 300, where the at least one 2DP 400 is made of a dielectric material other than air, and where the at least one 2DP 400 is disposed at a defined distance t4 from the substrate 200 and extends substantially parallel to the substrate 200 in a lengthwise direction parallel to the z-axis of the EM device 130; and, a 3DP 1000 disposed sideways adjacent to and on a first side 420 of the at least one 2DP 400, where the 3DP 1000 is made of a dielectric material other than air, where the 3DP 1000 is disposed on the substrate 200 and extends substantially parallel to the substrate 200 in a lengthwise direction parallel to the z-axis of the EM device 130, and where a thickness t4 of the 3DP 1000 defines the defined distance t4 of the at least one 2DP 400 from the substrate 200. In the EM device 130, the at least one 2DP 400 forms a DWG that is adapted for internal transmission of an EM radiation field originating from the at least one 1DP 300 when the at least one 1DP 300 is electromagnetically excited. The EM device 130 further includes a 4DP 1100 disposed sideways adjacent to and on a second side 422 opposite the first side 420 of the at least one 2DP 400, the 4DP 1100 being made of a dielectric material other than air and extending substantially parallel to the substrate 200 in a lengthwise direction parallel to the z-axis of the EM device 130. As depicted in FIG. 14, the at least one 1DP 300 is disposed at a first end 212 of the substrate 200, and the at least one 2DP 400, the 3DP 1000, and the 4DP 1100, each extend from the first end 212 to a second end 214, that opposes the first end 212, of the substrate 200.

In an embodiment, the EM device 130 further includes an EM reflector 460 disposed proximate the first end 212 of the substrate 200 within or adjacent to the at least one 2DP 400. The EM reflector 460 is disposed and adapted to reorient the EM radiation field originating from the at least one 1DP 300 from a first direction 610, depicted in FIG. 14 as the negative-y-direction, to a second direction 620, depicted in FIG. 14 as the z-direction, where the second direction 620 is within and in a direction substantially parallel to the at least one 2DP 400. In an embodiment, the EM reflector 460 is made of metal. In an embodiment, the EM reflector 460 is embedded within the at least one 2DP 400. In an alternative embodiment, the EM reflector 460 is a dielectric interface between the at least one 2DP 400 and another dielectric medium 470. In an embodiment, the dielectric medium 470 is air. In an alternative embodiment, the dielectric medium 470 is a contiguous wedge-like extension of the 4DP 1100.

In an embodiment of the EM device 130, the at least one 1DP 300 is an all-dielectric material having a first average dielectric constant, the at least one 2DP 400 is an all-dielectric material having a second average dielectric constant, the 3DP 1000 is an all-dielectric material having a third average dielectric constant, and the 4DP 1100 is an all-dielectric material having a fourth average dielectric constant, where the first average dielectric constant is greater than the second average dielectric constant, where the second average dielectric constant is greater than the third average dielectric constant, and where the second average dielectric constant is greater than the fourth average dielectric constant. In an embodiment, the fourth average dielectric constant is equal to the third average dielectric constant.

As will be appreciated by use of like reference numerals to describe like elements, the structural and material characteristics for certain elements described above in connection with EM devices 110 and 120 also apply to like elements as described herein in connection with EM device 130, such as lengths L1, L2, LC, LD and LE, and the aforementioned average dielectric constants, for example.

Figure 15:
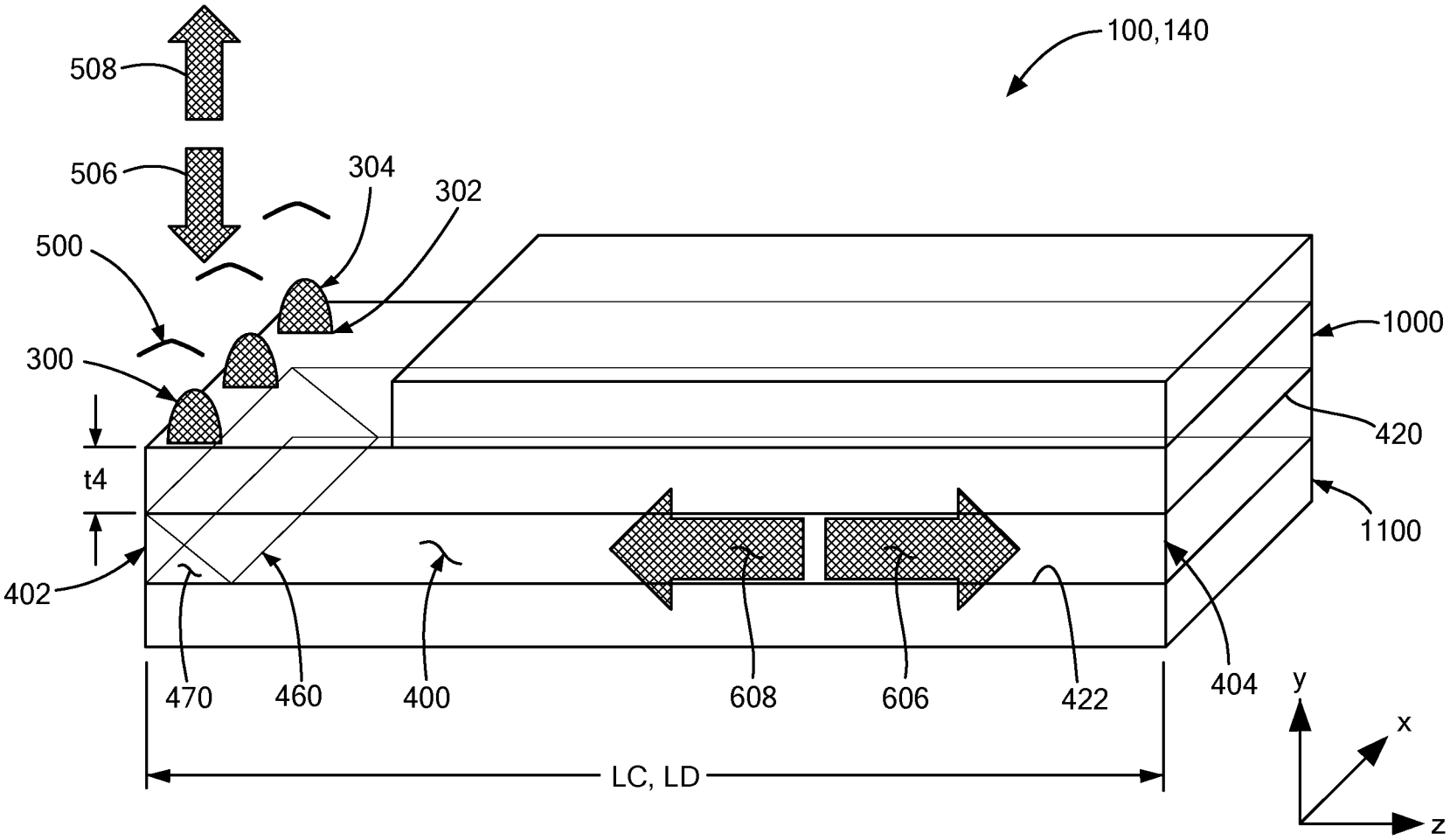

FIG. 15 depicts an EM device, generally enumerated by reference numeral 100 and particularly enumerated by reference numeral 140, similar to the EM device 130 depicted in FIG. 14, but with some differences that will now be described. In an embodiment, the EM device 140 includes: at least one 1DP 300 having a proximal end 302 and a distal end 304, each of the at least one 1DP 300 being made of a dielectric material other than air, where the distal 304 and proximal 302 ends of the at least one 1DP 300 are configured and adapted to emit an EM radiation field 500 that propagates in a first direction 508 (parallel to the y-axis in FIG. 15, for example) from the proximal end 302 toward the distal end 304 of the at least one 1DP 300 when the at least one 1DP 300 is electromagnetically excited; at least one 2DP 400 having a proximal end 402 and a distal end 404, the proximal end 402 of the at least one 2DP 400 being disposed proximate the at least one 1DP 300, the at least one 2DP 400 being made of a dielectric material other than air, and the at least one 2DP 400 being disposed a defined distance t4 from the at least one 1DP 300. In an embodiment, the at least one 2DP 400 forms a DWG adapted for internal transmission in a second direction 606, 608 (parallel to the z-axis in FIG. 15, for example) of the EM radiation field, where the second direction is not parallel with the first direction. In an embodiment, the at least one 2DP 400 extends in a lengthwise direction from the proximal end 402 to the distal end 404 in the second direction (parallel to the z-axis in FIG. 15, for example). A 3DP 1000, made of a dielectric material other than air, is disposed sideways adjacent to and on a first side 420 of the at least one 2DP 400, where the 3DP 1000 is disposed between the at least one 1DP 300 and the at least one 2DP 400, and where a thickness t4 of the 3DP 1000 defining the defined distance t4 of the at least one 2DP 400 from the at least one 1DP 300, and where the 3DP 1000 extends in a lengthwise direction substantially parallel to the at least one 2DP 400 in the second direction (parallel to the z-axis, for example). A 4DP 1100, made of a dielectric material other than air, is disposed sideways adjacent to and on a second side 422 opposite the first side 420 of the at least one 2DP 400, where the 4DP 1100 extends in a lengthwise direction substantially parallel to the 3DP 1000 in the second direction (parallel to the z-axis in FIG. 15, for example). An EM reflector 460 is disposed proximate the proximal end 402 of the at least one 2DP 400 and within or adjacent to the at least one 2DP 400, where the EM reflector 460 has an angle of reflection that is disposed and adapted to reorient the EM radiation field 500 from a first direction 506 (parallel to the y-axis of FIG. 15, for example) to a second direction 606 (parallel to the z-axis of FIG. 15, for example), or from a second direction 608 (parallel to the z-axis of FIG. 15, for example) to a first direction 508 (parallel to the y-axis of FIG. 15, for example). In an embodiment, the EM reflector 460 is made of metal. In an embodiment, the EM reflector 460 is embedded within the at least one 2DP 400. In an alternative embodiment, the EM reflector 460 is a dielectric interface between the at least one 2DP 400 and another dielectric medium 470. In an embodiment, the dielectric medium 470 is air. In an alternative embodiment, the dielectric medium 470 is a contiguous wedge-like extension of the 4DP 1100.

In an embodiment, the EM device 140 is adapted and configured as a transmit device where the first direction of the EM radiation field is toward the at least one 2DP 400, as depicted by reference numeral 506 for example, and the second direction of the EM radiation field is from the proximal end 402 toward the distal end 404 of the at least one 2DP 400, as depicted by reference numeral 606 for example. In another embodiment, the EM device 140 is adapted and configured as a receive device where the first direction of the EM radiation field is away from the at least one 2DP 400, as depicted by reference numeral 508 for example, and the second direction of the EM radiation field is from the distal end 404 toward the proximal end 402 of the at least one 2DP 400, as depicted by reference numeral 608 for example.

In an embodiment of the EM device 140, the at least one 1DP 300 is an all-dielectric material having a first average dielectric constant, the at least one 2DP 400 is an all-dielectric material having a second average dielectric constant, the 3DP 1000 is an all-dielectric material having a third average dielectric constant, and the 4DP 1100 is an all-dielectric material having a fourth average dielectric constant, where the first average dielectric constant is greater than the second average dielectric constant, where the second average dielectric constant is greater than the third average dielectric constant, and where the second average dielectric constant is greater than the fourth average dielectric constant. In an embodiment, the fourth average dielectric constant is equal to the third average dielectric constant.

As will be appreciated by use of like reference numerals to describe like elements, the structural and material characteristics for certain elements described above in connection with EM devices 110, 120 and 130 also apply to like elements as described herein in connection with EM device 140, such as lengths L1, L2, LC, LD and LE, and the aforementioned average dielectric constants, for example.

Figure 16:
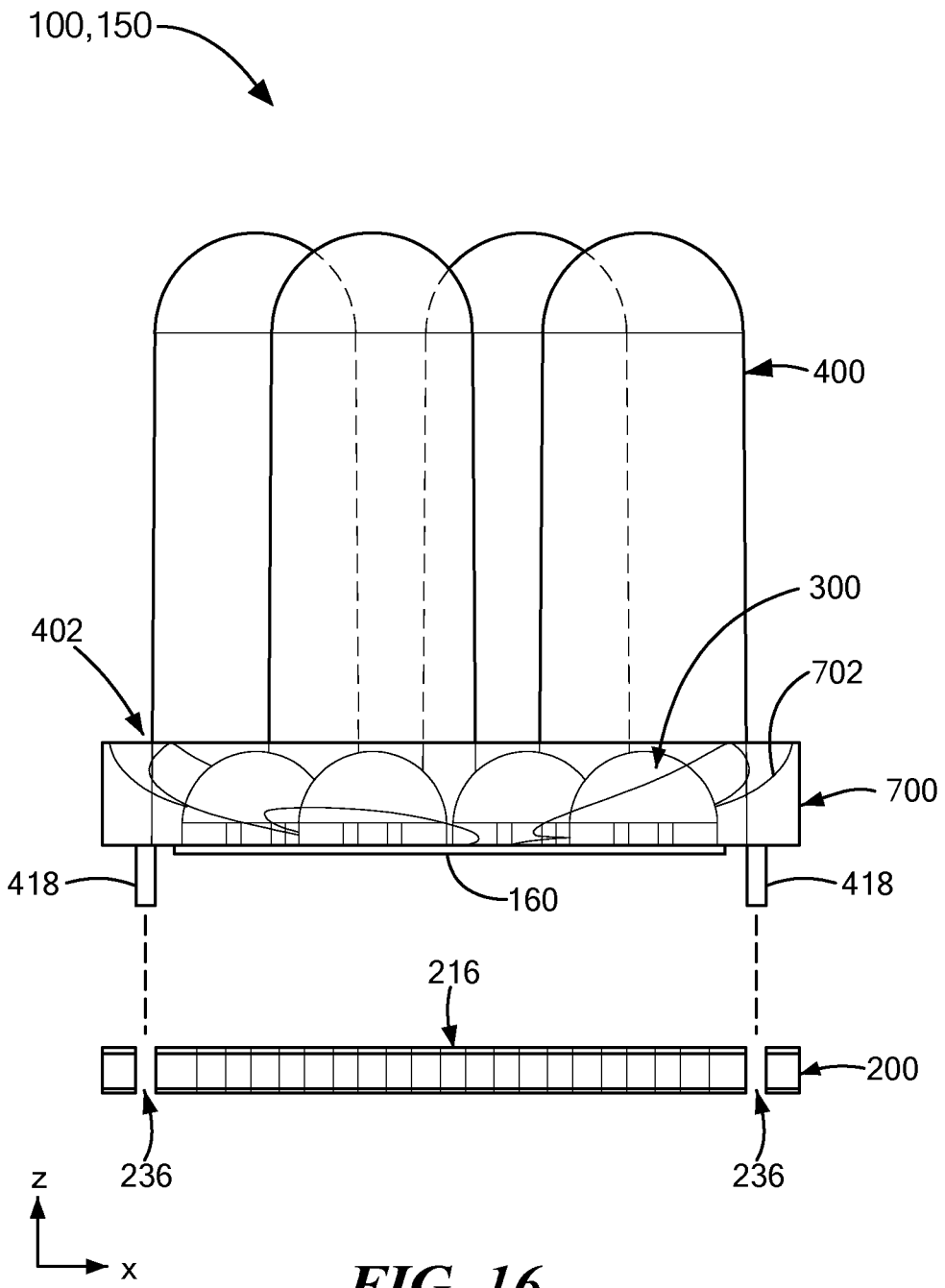
FIG. 16 depicts a transparent end view of an EM device comparable to that of FIG. 6, in accordance with an embodiment.

With reference now to FIG. 16 in combination with FIGS. 3-6 and 7B, an EM device, generally enumerated by reference numeral 100 and particularly enumerated by reference numeral 150, includes a connected array of DRAs 300 composed of at least one non-gaseous dielectric material, as described herein above, where in an embodiment an adhesive layer 160 is disposed under the connected array of DRAs 300, where the adhesive layer 160 is made of a material that is different from the at least one non-gaseous dielectric material of the connected array of DRAs 300. In an embodiment, the EM device 150 further includes at least one DWG 400 disposed in EM signal communication with and attached to the connected array of DRAs 300, in a manner disclosed herein above, where the at least one DWG 400 is oriented upward parallel to the z-axis of the EM device 150. In an embodiment, the connected array of DRAs 300 are made of a dielectric material having a first average dielectric constant, and the at least one DWG 400 is made of a dielectric material having a second average dielectric constant that is less than the first average dielectric constant. In an embodiment, the first and second dielectric constants are equivalent to the first and second dielectric constants disclosed and described herein above.

In an embodiment, the EM device 150 further includes a non-metallic all-dielectric structure 700, see structure 700 described herein above, disposed substantially around the array of DRAs 300, and disposed at the proximal end 402 of the at least one DWG 400. In an embodiment, the non-metallic all-dielectric structure has a dielectric constant that substantially matches the dielectric constant of the array of DRAs 300. In an embodiment, the non-metallic all-dielectric structure 700 is integral and monolithic with the array of DRAs 300. In an embodiment, the non-metallic all-dielectric structure 700 has dielectric constant that substantially matches the dielectric constant of the at least one DWG 400. In an embodiment, the non-metallic all-dielectric structure 700 is integral and monolithic with the at least one DWG 400. In an embodiment, the adhesive layer 160 has a dielectric constant that substantially matches the dielectric constant of the at least one DWG 400. In an embodiment, the non-metallic all-dielectric structure 700 comprises a curved surface 702 having a focal point 704 substantially coincidental with a geometrical center of the array of DRAs, see focal point 704 described herein above in connection with FIGS. 5 and 6.

In an embodiment, the EM device 150 further includes at least one dielectric projection or pin 418 integrally formed with the at least one DWG 400, such that the at least one DWG 400 and the at least one dielectric projection or pin 418 form a monolithic, and where the at least one dielectric projection or pin 418 is oriented downward parallel to the z-axis of the EM device 150.

In an embodiment, the EM device 150 is adapted and configured to be attachable to a substrate 200 having a plurality of pockets 236 for receiving corresponding ones of the projections or pins 418, and an engagement surface 216 for engaging with the adhesive layer 160, to properly align and securely attach the combination of the connected array of DRAs 300 and the at least one DWG 400 to the substrate 200.

In any embodiment disclosed herein having the at least one 2DP 400 at least partially bounded by another dielectric medium that forms dielectric interface between the at least one 2DP 400 and the other dielectric medium, such dielectric interface may be configured so as to result in total internal reflection of the EM signal that propagates within the at least one 2DP 400. FIG. 11 depicts an example analytic model of a 3DP 900 having a dielectric interface to ambient that is configured so as to result in total internal reflection of the EM signal that propagates within the 3DP 900.

While certain combinations of individual features have been described and illustrated herein, it will be appreciated that these certain combinations of features are for illustration purposes only and that any combination of any of such individual features may be employed in accordance with an embodiment, whether or not such combination is explicitly illustrated, and consistent with the disclosure herein. Any and all such combinations of features as disclosed herein are contemplated herein, are considered to be within the understanding of one skilled in the art when considering the application as a whole, and are considered to be within the scope of the appended claims in a manner that would be understood by one skilled in the art.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

The invention claimed is:

1. An electromagnetic, EM, device, comprising:

a substrate;

at least one dielectric resonator antenna, DRA, the at least one DRA having a proximal end and a distal end disposed at a distance away from the proximal end, the proximal end of the at least one DRA being disposed on the substrate; and at least one dielectric waveguide, DWG, configured so that during operation of the EM device the at least one DWG is disposed in EM signal communication with the at least one DRA;

wherein the at least one DWG has a proximal end disposed proximate the distal end of the DRA;

wherein the at least one DWG has a three-dimensional, 3D, shape that is different from a 3D shape of the at least one DRA;

wherein the at least one DRA is an all-dielectric material having a first average dielectric constant;

wherein the at least one DWG is an all-dielectric material having a second average dielectric constant; and wherein the first average dielectric constant is greater than the second average dielectric constant.

2. The EM device of claim 1, wherein:

the at least one DRA is configured to provide an electromagnetic signal to the at least one DWG.

3. The EM device of claim 1, wherein:

the at least one DWG is configured to provide an electromagnetic signal to the at least one DRA.

4. The EM device of claim 1, wherein:

the at least one DRA extends substantially perpendicular to the substrate.

5. The EM device of claim 1, wherein the at least one DRA and the at least one DWG are in direct contact with each other.

6. The EM device of claim 1, wherein the at least one DRA and the at least one DWG form an integral monolithic structure.

7. The EM device of claim 1, wherein:

the substrate comprises at least one signal feed disposed and adapted to electromagnetically excite corresponding ones of the at least one DRA.

8. The EM device of claim 1, wherein the proximal end of the DWG is also disposed on the substrate.

9. The EM device of claim 1, wherein:

the at least one DRA comprises a dielectric material other than air; and the at least one DWG comprises a dielectric material other than air.

10. The EM device of claim 1, wherein:

the at least one DRA when electromagnetically excited radiates an EM signal to the at least one DWG;

the at least one DWG is adapted and disposed to internally propagate the EM signal.

11. The EM device of claim 10, wherein:

the at least one DWG is adapted and disposed to internally propagate the EM signal with total internal reflection of the EM signal within the at least one DWG.

12. The EM device of claim 1, wherein:

the first average dielectric constant is equal to or greater than 4 and equal to or less than 18; and the second average dielectric constant is greater than 1 and equal to or less than 9.

13. The EM device of claim 1, wherein:

the at least one DRA comprises a plurality of the at least one DRA;

the at least one DWG is a single DWG; and each of the plurality of the at least one DRA is electromagnetically coupled to the single DWG.

14. The EM device of claim 13, wherein:

each DRA of the plurality of the at least one DRA is configured to radiate a corresponding one of the EM signal; and the single DWG is configured to collectively propagate the corresponding EM signals.

15. The EM device of claim 1, wherein:

the at least one DWG has a convex shaped distal end.

16. The EM device of claim 1, wherein:

the at least one DRA comprises a plurality of the at least one DRA arranged in an array;

the array of the at least one DRA is a connected array of DRAs comprising at least one non-gaseous dielectric material, the array of DRAs having a proximal end and a distal end; and an adhesive layer disposed under the connected array of DRAs at the proximal end, wherein the adhesive layer comprises a material different from the at least one non-gaseous dielectric material.

17. The EM device of claim 16, wherein:

the least one DWG is attached to the connected array of DRAs, the at least one DWG being oriented upward parallel with a z-axis of the EM device;

wherein the connected array of DRAs comprises a dielectric material having a first average dielectric constant;

wherein the at least one DWG comprises a dielectric material having a second average dielectric constant that is less than the first average dielectric constant; and further comprising at least one dielectric pin integrally formed with the at least one DWG, such that the at least one DWG and the at least one pin form a monolithic, wherein the at least one pin is oriented downward parallel with the z-axis of the EM device.

18. The EM device of claim 17, further comprising:

a non-metallic all-dielectric structure disposed substantially around the array of DRAs.

19. The EM device of claim 18, wherein:

the non-metallic all-dielectric structure comprises a curved surface having a focal point substantially coincidental with a geometrical center of the array of DRAs.

20. The EM device of claim 19, wherein:

the non-metallic all-dielectric structure is integrally formed with and monolithic with either the array of DRAs or the at least one DWG.

* * * * *